US008187155B2

(12) United States Patent
Ooka

(10) Patent No.: US 8,187,155 B2
(45) Date of Patent: May 29, 2012

(54) TRAINING MACHINE

(75) Inventor: Akihiro Ooka, Shiga (JP)

(73) Assignee: Tanren Co., Ltd., Shiga (JP)

( * ) Notice: Subject to any disclaimer, the term of this patent is extended or adjusted under 35 U.S.C. 154(b) by 591 days.

(21) Appl. No.: 10/975,055

(22) Filed: Oct. 28, 2004

(65) Prior Publication Data

US 2005/0101451 A1 May 12, 2005

(30) Foreign Application Priority Data

Nov. 6, 2003 (JP) ..... 2003-377208

(51) Int. Cl.
*A63B 21/00* (2006.01)

(52) U.S. Cl. ..... 482/93; 482/98; 482/99; 482/102

(58) Field of Classification Search ..... 482/121, 482/102, 138, 93, 98, 99; 54/46.1
See application file for complete search history.

(56) References Cited

U.S. PATENT DOCUMENTS 592,588 A * 10/1897 Hollister ..... 54/46.1
1,222,480 A * 4/1917 Smith ..... 267/70
4,951,943 A * 8/1990 Farenholtz ..... 482/138
4,988,095 A * 1/1991 Ferrari ..... 482/102
5,050,872 A 9/1991 Farenholtz

FOREIGN PATENT DOCUMENTS

| | | |
|---|---|---|
| JP | 6-7475 | 1/1994 |
| JP | 8-5729 | 2/1996 |
| JP | 2567491 | 12/1997 |
| JP | 2002-310218 | 10/2002 |

* cited by examiner

*Primary Examiner* — Jerome w Donnelly
(74) *Attorney, Agent, or Firm* — Westerman, Hattori, Daniels & Adrian, LLP

(57) ABSTRACT

A training machine is provided comprising a base (6) arranged for placement on the floor (4), a movable member (32) provided on the base (6) to be moved by the training action, and a load exerting means (8) for exerting a load to control the movement of the movable member (32). The load exerting means (8) has a weight assembly (22) thereof arranged to be lifted vertically by the movement of the movable member (32) as resisting the gravity and particular is accompanied with a counter-force exerting means (70) arranged at the weight assembly (22) and/or the movable member (32) for exerting a returning force on the movable member (32) at the timing of shift from the upward movement to the downward movement of the weight assembly (22). The counter-force exerting means (70) comprises, for example, coil springs (72, 74) and movement stoppers (76, 78) for restricting the movement of the coil springs (72, 74).

11 Claims, 16 Drawing Sheets

TRAINING MACHINE

FIELD OF THE INVENTION

The present invention relates to a training machine for lifting weights as resisting against the gravity in order to exhaust and thus develop the muscles.

BACKGROUND OF THE INVENTION

Training machines have been provided in the market for lifting weights vertically as resisting against the gravity to develop the muscles. Such a training machine basically comprises a base placed on the floor, a movable member arranged movable in response to the movement of the body of an exerciser, and a load exerting means for exerting a load to control the movement of the movable member. The load exerting means includes weights provided for movement vertically along guide posts and connecting wires connecting between the weights and the movable member. (See Japanese Patent Laid-open Publication (Heisei) 6-7475).

In action of the training machine, the movable member is moved to a target position by an exerciser contracting its muscles for physical training. As the movable member is moved, it causes the weights to lift up via the connecting wires as resisting against the gravity. The weights in turn provide a load to control the movement of the movable member. When the movable member has been moved to the target position by the exerciser contracting its muscles, the weights reach at a corresponding uppermost point. This is followed by the exerciser relaxing the muscles so that the movable member returns back to its original position. As the movable member is being moved back towards the original position, its sustaining the weights connected by the connecting wires lift down due to the effect of their gravity. The muscles are contracted until the movable member reaches at its target position and then relaxed with the weights pulling the movable member up to the original position. As the muscles repeat the contracting and relaxing action for the training, they can be built up through their exhaustion and stimulation.

However, the training machine has two major drawbacks, which are based on the use of weights. Firstly, when the muscles has been contracted to drive the movable member to the target position, their behavior is at the most contracted state or in the other words, the most stimulated state. As the muscles are relaxed to move back the movable member from the target position to the original position, they allow the weights to shift from the upward movement to the downward movement. In case that the weight are lifted up by a force greater than their gravity to moved the movable member, they may pop up at the uppermost point (upon the timing of shift from the upward movement to the downward movement). The pop up of the weights will thus interrupt the training action of the movable member and provide no load to the exerciser. When the exerciser receives no load from the weights at the most contracted state of its muscles (at the uppermost point of the weights), its muscles will abruptly be released from the maximum tension. As the muscles relax unintentionally, their stimulation will be declined hence permitting no development of the muscles.

Secondly, when the weights are lifted up, they resist against their gravity and thus provide the exerciser with a load which becomes greater when the speed of the training movement is increased. When the weights are lifted down, their gravity undergoes the downward movement. As the speed of its training movement becomes closer to the speed of the gravity, the exerciser receives a less load from the weights and their muscles will be less susceptible to the load. Accordingly, the muscles can remain highly responsive to the load during the upward movement of the weights but blunt during the downward movement of the weight.

It is hence essential for avoiding the abrupt relaxation of the muscles at the timing of shift from the upward movement to the downward movement of the weights to drive the movable member (or the weights) with a force substantially equal to the gravity of the weights. It is also necessary for inhibiting the relaxation of the muscles during the downward movement of the weights to drive the movable member at a speed lower than the downward movement. Most of the existing training books recommend that the training action should be conducted as at moderate speeds as possible. This however requires every exerciser to carefully control the speed for driving the movable member or the upward and downward movement of the weights during the training action. As a result, the exerciser has to concentrate its attention on the speed and will thus suffer from a mental stress. It is particularly troublesome for a beginner to exercise with control of the movement.

It is hence an object of the present invention to provide a training machine which can eliminate any pop up movement of the weights at the timing of shift from the upward movement to the downward movement even when the weights are lifted up with a force greater than their gravity.

SUMMARY OF THE INVENTION

As defined in claim 1 of the present invention, a training machine comprising a base arranged for placement on the floor, a movable member provided on the base to be moved by the training action, and a load exerting means for exerting a load to control the movement of the movable member is characterized in that the load exerting means has a weight assembly thereof arranged to be lifted vertically by the movement of the movable member as resisting the gravity and particular is accompanied with a counter-force exerting means arranged at the weight assembly and/or the movable member for exerting a returning force on the movable member at the timing of shift from the upward movement to the downward movement of the weight assembly.

In the training machine defined in claim 1, the load exerting means provided for exerting a load to control the movement of the movable member is equipped with the weight assembly arranged to be lifted vertically by the movement of the movable member as resisting the gravity and the counter-force exerting means arranged for exerting a returning force on the movable member at the timing of shift from the upward movement to the downward movement of the weight assembly. As the returning force is exerted on the movable member by the counter-force exerting means at the timing of shift from the upward movement to the downward movement of the weight assembly, it allows each exerciser to constantly bear the weight of the weight assembly. Accordingly, the exerciser remains tensed at its muscles at the timing of the movable member returning from its target position to the original position and can thus repeat the training action with its muscles kept under a degree of tension without allowing abrupt relaxation of the muscles and regardless of controlling over the moving speed of the movable member, ensuring effective stimulation and development of its muscles. The counter-force exerting means may be arranged at the movable member in place of the weight assembly or in addition to the weight member with equal success.

As defined in claim 2 of the present invention, the training machine is modified in which the movable member has a weight mount thereof provided for installation of the weight assembly while the counter-force exerting means is arranged at the weight mount and/or the movable member.

In the training machine defined in claim 2, the weight assembly is mounted to the weight mount of the movable member and can thus be moved together with the movable member. Since the counter-force exerting means is arranged at the weight mount and/or the movable member, it can exert the returning force on the movable member at the timing of shift from the upward movement to the downward movement of the weight assembly.

As defined in claim 3 of the present invention, the training machine is modified in which the load exerting means has guide posts thereof provided extending substantially in the vertical on the base and arranged on which the weight assembly is liftably mounted, the weight assembly and the movable member are connected to each other by a connecting means, and the counter-force exerting means is arranged at the weight assembly and/or the movable member.

In the training machine defined in claim 3, the weight assembly is liftably mounted on the guide posts which extend substantially in the vertical from the base and connected to the movable member by the connecting means such as a connecting wire. As the counter-force exerting means in the training machine is arranged at the weight assembly and/or the movable member, it can exert the returning force on the movable member at the timing of shift from the upward movement to the downward movement of the weight assembly.

As defined in claim 4 of the present invention, the training machine is modified in which the weight assembly stays at the lowermost point when the movable member is at its original position and is lifted up to an upward point higher than the lowermost point when the movable member is moved to a target position, and wherein the counter-force exerting means is arranged at the movable member to exert a counter force on the movable member when the weight assembly is lifted up close to the upward point by the movement of the movable member towards the target position, whereby the movable member can be urged by a returning force.

In the training machine defined in claim 4, the weight assembly is at the lowermost point when the movable member stays at the original position and then lifted up to the upward point when the movable member is moved from the original position to the target position. As the movement of the movable member is repeated, the weight assembly is lifted up and down between the lowermost point and the upward point. The counter-force exerting means arranged at the movable member exerts a counter force on the movable member when the weight assembly is lifted up close to the upward point by the movement of the movable member. Accordingly, the movable member can receive the counter force as a returning force at the timing of shift form the upward movement to the downward movement of the weight assembly. This allows each exerciser to constantly bear the weight of the weight assembly while receiving the returning force from the counter-force exerting means and conduct the training action through the movement of the movable member with its muscles remaining under a degree of tension.

As defined in claim 5, the training machine is modified in which the counter-force exerting means comprises an expandable member provided between the base and the movable member, a coil spring mounted to as sheathed on the expandable member, and an actuator member arranged for acting on the coil spring as moving together with movable member, and wherein when the weight assembly is lifted up close to the upward point by the movement of the movable member towards the target position, the actuator member acts on and compresses the coil spring which in turn exerts a counter or returning force on the movable member.

In the training machine defined in claim 5, as the expandable member, the coil spring, and the actuator member are provided for constituting the counter-force exerting means, the expandable member is mounted at one end to the base and at the other end to the movable member, the coil spring is mounted to as sheathed on the expandable member, and the actuator member is arranged to move together with the movable member. When the weight assembly is lifted up closed to the upward point by the movement of the movable member towards the target position, the actuator member comes into contact with and compresses the coil spring. In turn, the compression of the coil spring creates a counter force which is then exerted as a returning force on the movable member. This allows each exerciser to constantly bear the weight of the weight assembly and conduct the training action through the movement of the movable member with its muscles remaining under a degree of tension.

As defined in claim 6 of the present invention, the training member is modified in which the expandable member comprises a main body and an expandable rod arranged to be inserted into the main body, the main body mounted to the base, the expandable member mounted to the movable member, and wherein the coil spring is mounted to as sheathed on the main body and the actuator member is mounted to the expandable rod so that its location can selectively be determined.

In the training machine defined in claim 6, the main body of the expandable member is mounted to the base while the expandable rod mounted to the movable member. Also, the coil spring is mounted to as sheathed on the main body while the actuator member is mounted to the expandable rod. Accordingly, when the movable member is moved towards the target position (with the weight assembly lifted up close to the upward point), the actuator member comes into direct contact with and compresses the upper end of the coil spring. In turn, the compression of the coil spring creates a counter force. Since the location of the actuator member is adjustably determined on the expandable rod, the compression of the coil spring when the movable member moving towards the target position (i.e. the weight assembly being lifted up close to the upward point) can arbitrarily be modified, hence determining a desired rate of the counter force for the training action.

As defined in claim 7 of the present invention, the training machine is modified in which the weight assembly connected with the connecting means stays at the lowermost point when the movable member is at its original position and is lifted up to an upward point via the connecting means when the movable member is moved to a target position, and wherein the counter-force exerting means is arranged at the weight assembly to exert a counter force on the weight assembly when the weight assembly is lifted up close to the upward point by the movement of the movable member towards the target position, whereby the movable member can be urged by a returning force.

In the training machine defined in claim 7, when the movable member connected by the connecting means to the weight assembly is at the original position, the weight assembly stays at the lowermost point. When the movable member is moved to the target position, its movement lifts up the weight assembly connected by the connecting means to the upward point. The counter-force exerting means arranged at the weight assembly exerts a counter force on the weight assembly in response to the weight assembly lifting up close to the upward point. Accordingly, the counter force is transmitted via the connecting means to the movable member and acts as a returning force on the movable member at the timing of shift from the upward movement to the downward movement of the weight assembly. This allows each exerciser to constantly bear the weight of the weight assembly without popping up of the weight assembly because the returning force is exerted on the movable member by the counter-force exerting means at the timing of shift in the lifting movement of the weight assembly and conduct the training action through the repeated movement of the movable member with its muscles remaining under a degree of tension.

As defined in claim 8 of the present invention, the training machine is modified in which the counter-force exerting means comprises coil springs mounted to the uppermost end of the weight assembly as sheathed on the guide posts respectively and movement stoppers arranged for restricting the upward movement of the coil springs which can be lifted up and down together with the weight assembly, and wherein when the weight assembly is lifted up close to the upward point, the movement stoppers come into contact with and restrict the upward movement of the coil springs, whereby the coil springs upon being compressed can exert a counter force on the weight assembly.

In the training machine defined in claim 8, the coil springs provided in combination with the movement stoppers for constituting the counter-force exerting means are mounted to the upper end of the weight assembly as sheathed on the guide posts and can be lifted up and down together with the weight assembly. The movement stoppers is arranged to restrict the movement of the coil springs. When the weight assembly is lifted up close to the upward point by the movement of the movable member towards the target position, the movement stoppers come into contact with and restrict the upward movement of the coil springs which are then compressed. The compression of the coil springs creates a counter force exerted on the weight assembly thus inhibiting the popping up of the weight assembly. The counter force is also transmitted via the connecting means to and acts as a returning force on the movable member. This allows an exerciser to constantly bear the weight of the weight assembly and conduct the training action through the repeated movement of the movable member with its muscles remaining under a degree of tension. Also, as the weight assembly is lifted up at a higher speed, its kinetic energy will increase thus accelerating the popping up of the weight assembly at the uppermost point. However, the higher the upward movement of the weight assembly, the greater the elastic deformation of the coil springs will increase thus generating a higher level of the counter force. As a result, the weight assembly can certainly be inhibited from popping up.

As defined in claim 9 of the present invention, the training machine is modified in which the movement stoppers are mounted to the guide posts respectively so that their location can selectively be determined.

In the training machine defined in claim 9, the movement stoppers are mounted to desired locations on the guide posts. The compression of the coil springs by the weight assembly lifted up can thus be adjusted to a desired rate by determining the locations of the movement stoppers on the guide posts. Accordingly, the counter force for the training action can arbitrarily be controlled.

As defined in claim 10 of the present invention, the training machine is modified in which each of the coil springs of the counter-force exerting means comprises a first coil spring segment which is comparatively high in the spring constant and a second coil spring segment which is comparatively low in the spring constant, and wherein the first coil spring segments exert the counter-force while the second coil spring segments provide a cushioning effect.

In the training machine defined in claim 10, the first coil spring segments of the coil springs of the counter-force exerting means are comparatively high in the spring constant while the second coil spring segments are comparatively low in the spring constant. Accordingly, the first coil spring segments can exert the counter-force on the movable member at the timing of shift from the upward movement to the downward movement of the weight assembly while the second coil spring segments eases the effect of impact on the counter-force exerting means upon retraction.

As defined in claim 11 of the present invention, the training machine is modified in which the weight assembly further comprises a weight connecting rod joined to the connecting means, a number of weights mounted on the guide posts for lifting up and down, and a joining member for joining the number of weights to the weight connecting rod, the weight connecting rod having two or more connecting holes provided therein as spaced from one another across the axial direction, each of the weights having a through hole provided therein through which the weight connecting rod extends vertically and a recess provided therein for accepting the joining member, and wherein when corresponding one of the weights is joined to the weight connecting rod by the joining member inserting into the recess in the desired weight and the connecting hole in the weight connecting rod, a desired number of the weights including the corresponding weight and the weights located above the corresponding weight can be lifted up and down along the guide posts.

In the training machine defined in claim 11, the joining member provided together with the weight connecting rod and the weights for constituting the weight assembly is inserted across the recess in the desired weight into the connecting hole in the weight connecting rod. With the joining member extending across the recess in the desired weight and the through hole in the weight connecting rod, the desired weight is joined to the weight connecting rod. When the weight connecting rod is moved upward by the movement of the movable member connected by the connecting means, the joining member lifts up the desired weight. As a result, the desired weight and the other weights located above the desired weight can all be lifted up. By selecting one of the weights in to which the joining member is inserted, a desired number of the weights to be joined to the weight connecting rod can be determined thus adjusting the overall weight of the weight assembly with ease.

DETAILED DESCRIPTION OF THE PREFERRED EMBODIMENTS

Preferred embodiments of the training machine according to the present invention will be described referring to the accompanying drawings.

First Embodiment

A training machine according to the first embodiment of the present invention will be described referring to FIGS. 1 to 5.

Figure 1:
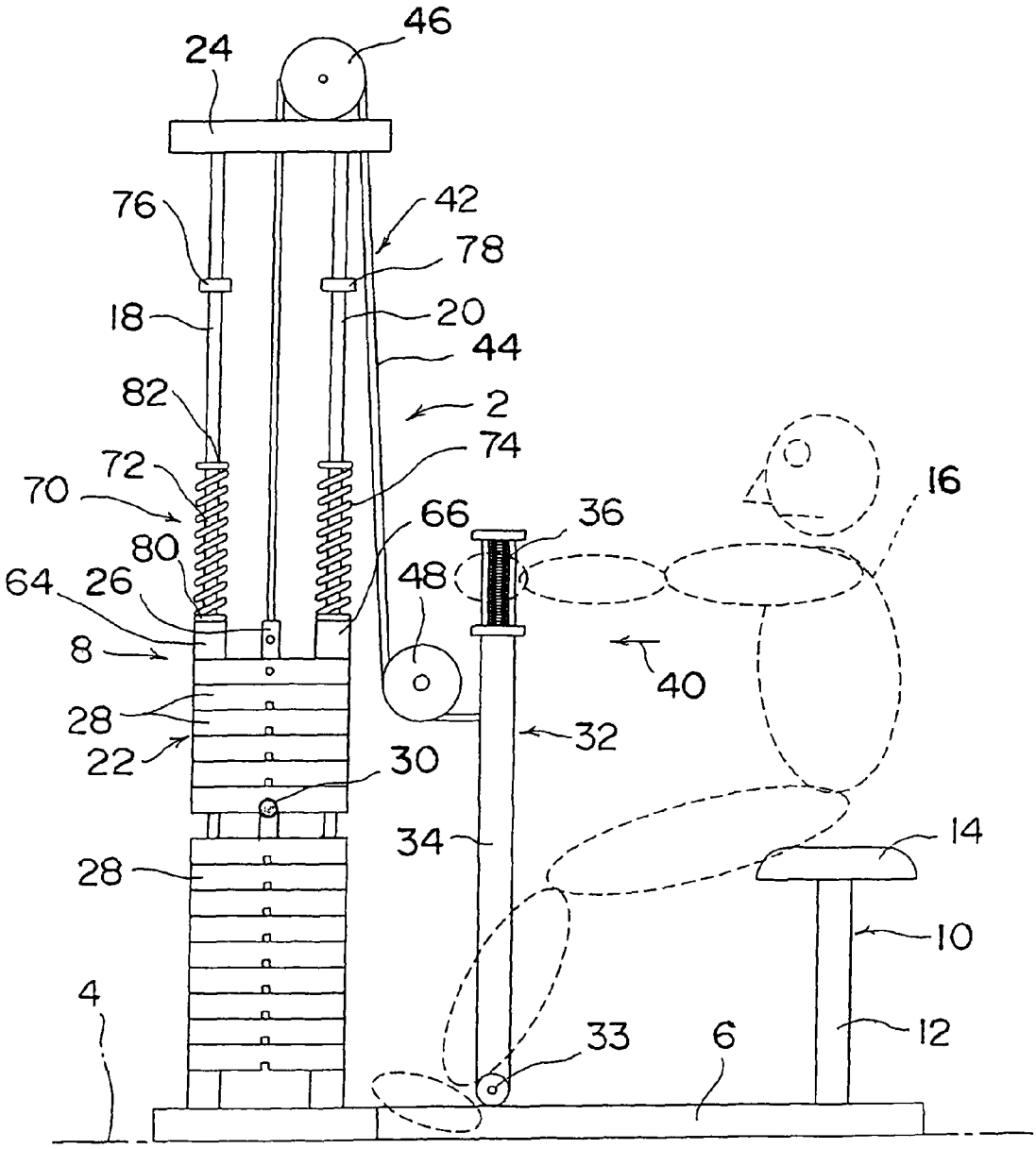
FIG. 1 is a side view schematically showing a training machine of a first embodiment of the present invention.
Figure 2:
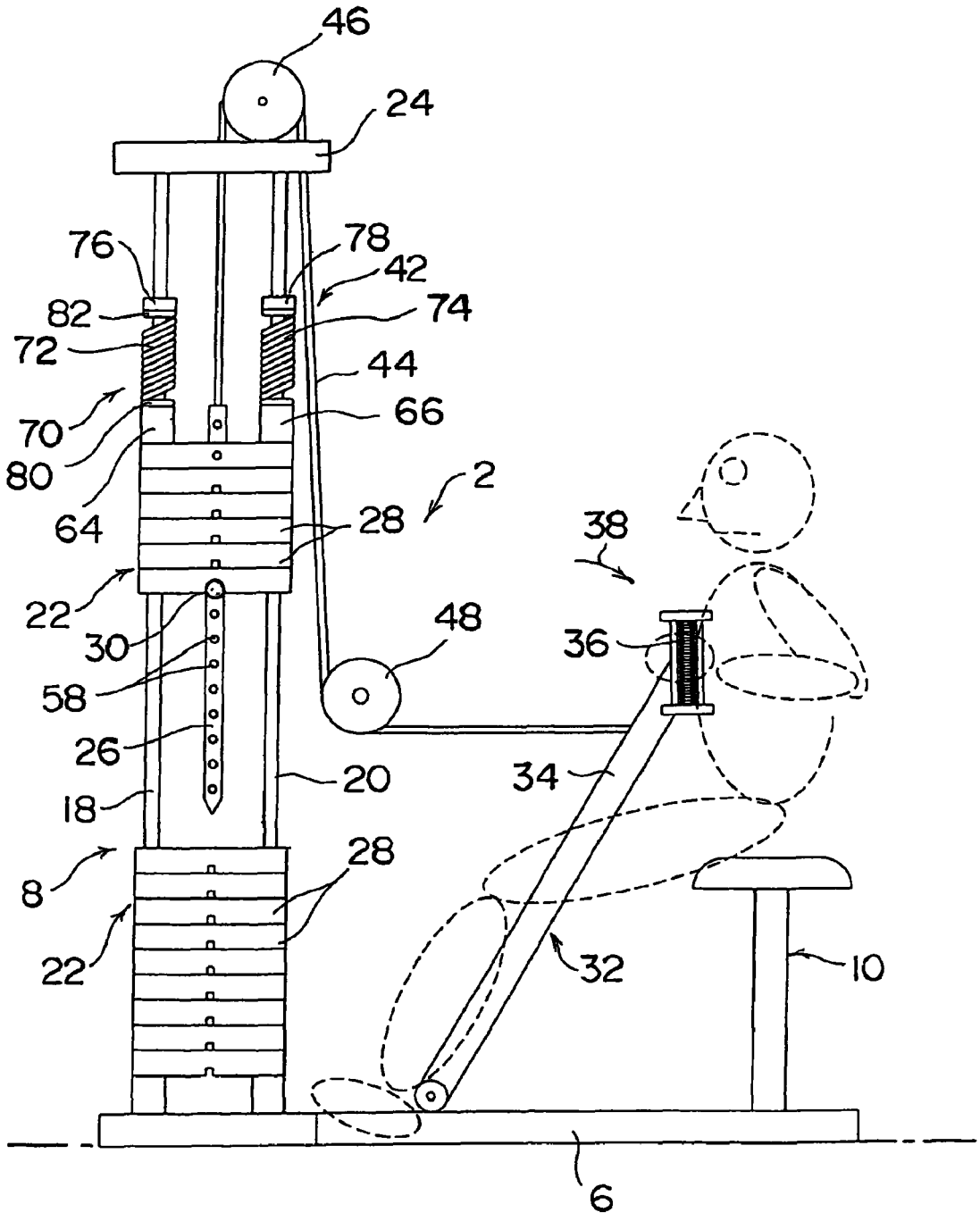
FIG. 2 is a side view of the training machine shown in FIG. 1 where the weights are lifted up to their uppermost point.

As shown in FIGS. 1 and 2, the training machine 2 of the first embodiment has a base 6 arranged for installation, for example, on the floor 4 of a training gymnasium. In this embodiment, the base 6 is accompanied at one side (on the left shown in FIG. 1 or 2) with a load exerting means 8 and at the other side (on the right shown in FIG. 1 or 2) with a stool 10. The stool 10 comprises a leg 12 fixedly mounted to the base 6 and a seat 14 mounted on the top of the leg 12. During the training action, an exerciser 16 sits on the seat 14 of the stool 10.

The load exerting means 8 comprises a pair of guide posts 18 and 20 arranged to extend vertically and upwardly from the base 6 and a weight assembly 22 provided for upward and downward movement along the guide posts 18 and 20. The two guide posts 18 and 20 are joined at the uppermost end to each other by a joining member 24. The weight assembly 22 is composed of a weight connecting rod 26, a group of weights 28, and a joining member 30 for joining a desired number of the weights 28 to the weight connecting rod 26. A desired number of the weights 28 can be joined by the joining member 30 to the weight connecting rod 26 as will be described later in more detail.

A movable member 32 is provided on substantially a center region in the lengthwise direction of the base 6 for movement (between the load exerting means 8 ad the stool 10). The movable member 32 includes a movable bar 34 pivotably mounted at the lowermost end by a pivot 33 to the base 6 and a pair of grips 36 (one shown in FIG. 1 or 2) mounted on the uppermost end of the movable bar 34 as spaced from each other along the traverse direction (vertical to the sheet of paper in FIG. 1 or 2). In the training action, the grips 36 of the movable member 32 are held and pivotably driven by the exerciser 16 between the original position shown in FIG. 1 and the target position shown in FIG. 2 in opposite directions denoted by the arrows 38 and 40.

The load exerting means 8 also has a connecting means 42 provided for connecting between the weight assembly 22 and the movable member 32. The connecting means 42 in this embodiment incorporates a connecting wire 44 which is joined at one end to (the uppermost end of the weight connecting rod 26 of) the weight assembly 22 and at the other end to (a portion close to the uppermost end of the movable bar 34 of) the movable member 32. A first transfer pulley 46 is rotatably mounted on an auxiliary frame (not shown) of the joining member 24 while a second transfer pulley 48 is rotatably mounted on a support frame (not shown) of the base 6. Accordingly, the connecting wire 44 extends from the weight assembly 22 to the movable member 32 as running on the first and second transfer pulleys 46 and 48.

When the movable member 32 is at the original position shown in FIG. 1, the weight assembly 22 joined to the connecting wire 44 stays at the lowermost point. When the movable member 32 is turned in the direction denoted by the arrow 38 to the target position shown in FIG. 2, it pulls the connecting wire 44 and lifts up the weight assembly 22 along the guide posts 18 and 20 to the corresponding uppermost point shown in FIG. 2. During the training action of the exerciser 16, the weight assembly 22 (a desired number of the weights 28 determined for the training action) travels up and down between the uppermost point and the lowermost point as acting as a load to control the movement of the movable member 32. When the training action is finished, the weight assembly 22 returns back to the lowermost point on the remaining of the weights 28 at the base 6. In other words, all the weights 28 are held in a stack on the base 6. Simultaneously, the movable member 32 remains at a non-movement position (not shown) as slightly tilted from the original position in a counter-clockwise direction in FIG. 1.

The weight assembly 22 and its related arrangement will be described in more detail referring to FIGS. 3 to 5 in addition to FIG. 1. Each the weight 28 in the weight assembly 22 is arranged of a rectangular block shape having a first round through hole 50 provided in the center thereof and a pair of second round through holes 52 and 54 provided therein on both sides of the first through hole 50. The first through hole 50 is greater in the inner diameter than the second through holes 52 and 54. Also, the weight 28 has a rectangular recess 56 provided in the lengthwise center of the lower side thereof.

Figure 3:
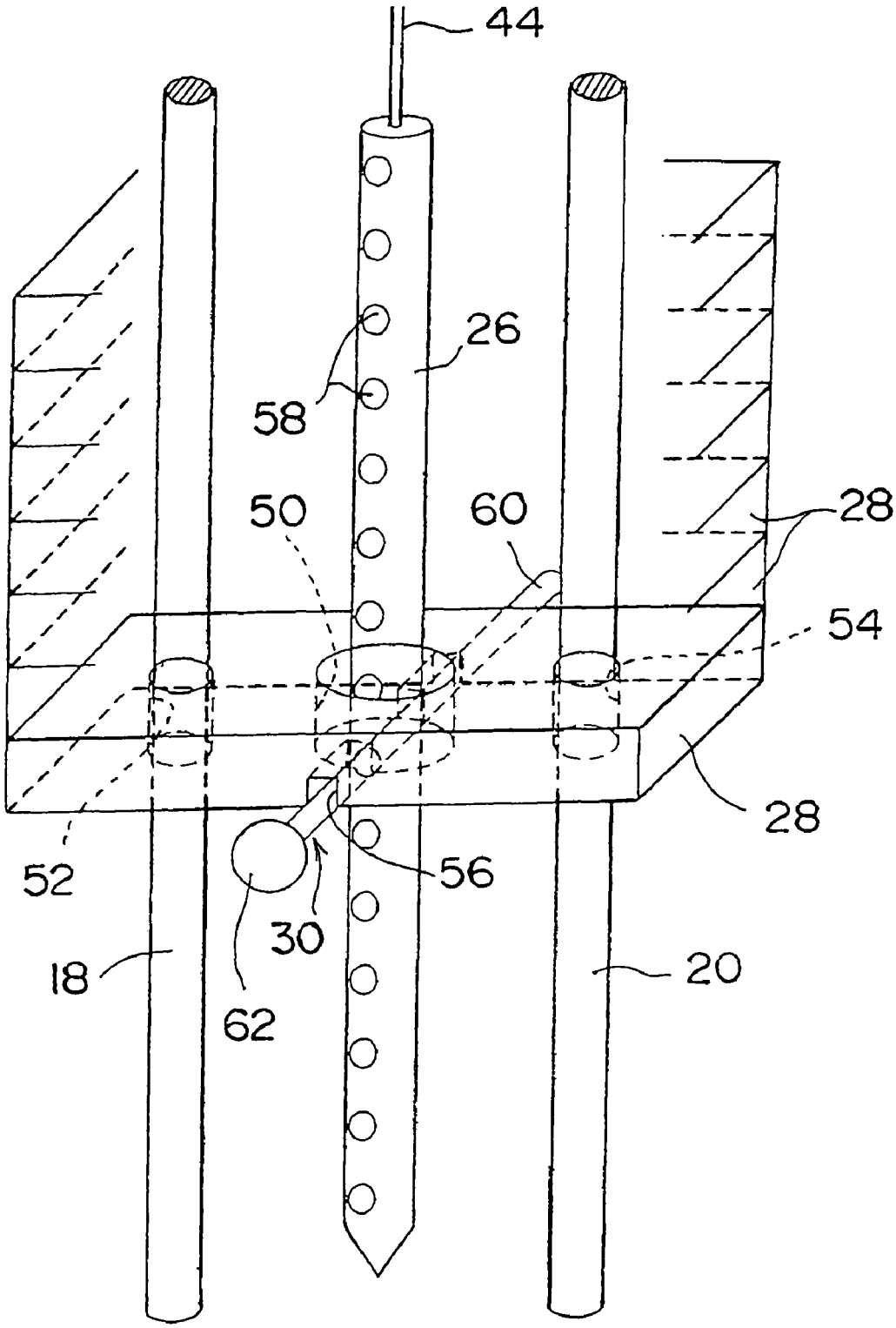
FIG. 3 is a perspective view of the weights in the training machine shown in FIG. 1.
Figure 4:
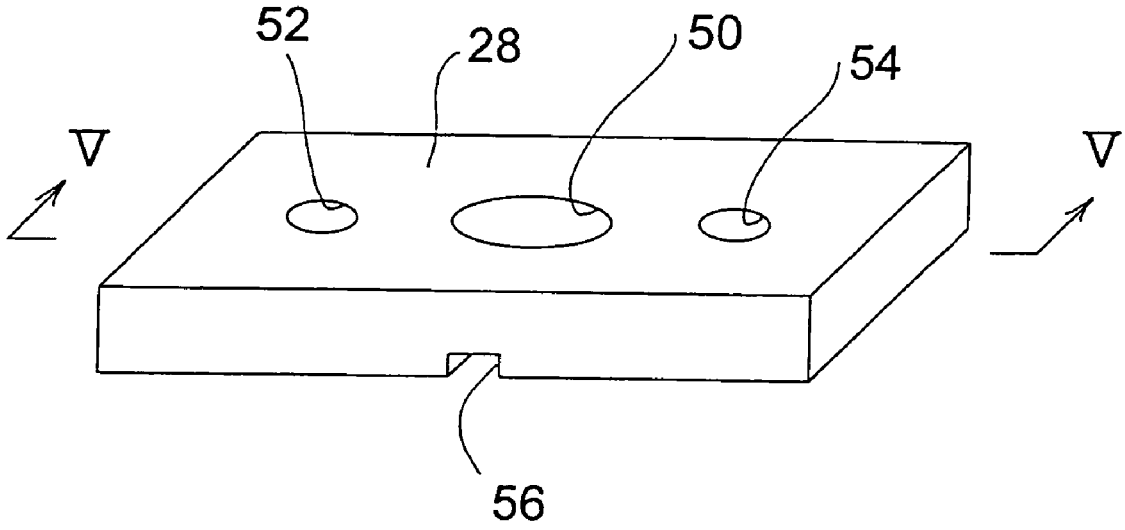
FIG. 4 is a perspective view of one of the weights shown in FIG. 3.
Figure 5:
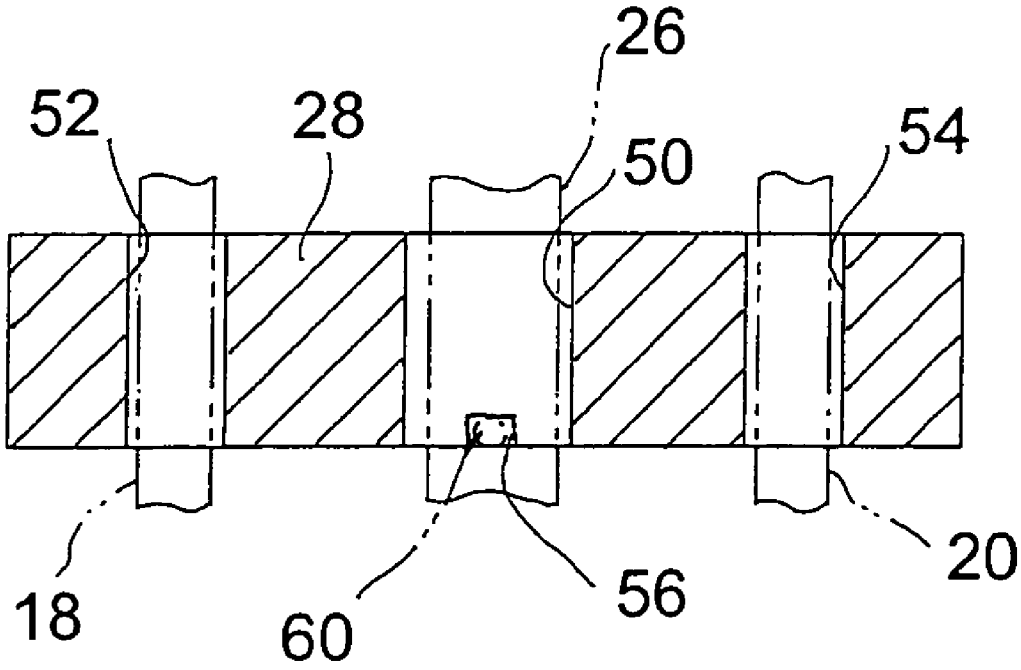
FIG. 5 is a cross sectional view taken along the line V-V of FIG. 4.

As illustrated in FIGS. 3 and 5, the guide posts 18 and 20 are two elongated rods which have a round shape in the cross section. The guide post 18 extends through the second through hole 52 of each weight 28 while the guide post 20 extends through the second through hole 54 of the same. The weight connecting rod 26 has a row of connecting holes 58 provided therein as spaced at equal intervals along the axial direction. The interval of any two adjacent connecting holes 58 is equal to the height of the weight 28. The cross section of the weight connecting rod 26 is round for ease of extending through the first through hole 50 of each weight 28. The joining member 30 comprises a rod 60 and a ball-like operating handle 62 mounted to one end of the rod 60. The rod 60 is arranged to extend through one of the connecting holes 58 in the weight connecting rod 26.

The weight 28 may weigh 5 kg (or 10 kg). Also, a sum of the weight connecting rod 26 and the joining member 30 may weight 5 kg. When it is desired, for example, to set the weight with 20 kg (or 25 kg, 30 kg, and so on) for carrying out a program of the training action, the weight connecting rod 26 is held to extend through the first through holes 50 of the weights 28 and then the rod 60 of the joining member 30 is inserted into the recess 56 of the third weight 28 from the top of the stack (referred to as a selected weight 28) to extend through the corresponding one of the connecting holes 58 in the weight connecting rod 26. More specifically, the rod 60 of the joining member 30 is set to extend horizontally across the recess 56 of the selected weight 28 and the corresponding one of the connecting holes 58 in the weight connecting rod 26 so that the selected weight 28 is detachably joined to the weight connecting rod 26 by the joining member 30. This allows the selected weight 28 and the other weights 28 located above the selected weight 28 to be lifted up together with the joining member 30 when the movement of the movable member 32 pulls the connecting wire 44 and lifts up the weight connecting rod 26. A sum of the selected weight 28 and the other weights 28 above the selected weight 28 forms the weight assembly 22 which thus weighs 20 kg (or 25 kg, 30 kg, and so on).

As easily understood, the weight of the weight assembly 22 can favorably be changed by determining the selected weight 28 to be joined to the weight connecting rod 26 by the joining member 30. For example, when the selected weight 28 is determined at the upper (or lower) of the stack and joined to the weight connecting rod 26 by the joining member 30, the weight of the weight assembly 22 to be used for the training action can be decreased (or increased).

In this embodiment, the uppermost one of the weights 28 at the stack has two support projections 64 and 66 provided on the upper surface at both ends thereof. The support projections 64 and 66 include bearing means (not shown) arranged for sliding up and down movement along and on the guide posts 18 and 20 respectively. This allows the weight assembly 22 to run smoothly along as being supported by the guide posts 18 and 20 with the second through holes 52 and 54 of each weight 28 remaining not directly sustained by the guide posts 18 and 20.

The training machine 2 of this embodiment further comprises a counter-load exerting means 70 for exerting a counter force on the movable member 32 at the timing of shift from the upward movement to the downward movement of the weight assembly 22. More specifically, the counter-force exerting means 70 shown comprises a pair of coil springs 72 and 74 arranged for moving up and down together with the weight assembly 22 and a pair of movement stoppers 76 and 78 for inhibiting the movement of the coil springs 72 and 74. The coil springs 72 and 74 are movably sheathed on the guide posts 18 and 20 respectively to stay above the uppermost one of the weights 28. In this embodiment, the coil springs 72 and 74 are supported at the bottom by the upper surfaces of the corresponding support projections 64 and 66 on the stack of the weights 28 and arranged to travel upwardly and downwardly when the weight assembly 22 is lifted up and down. The movement stoppers 76 and 78 are annular members fixedly mounted by retaining screws (not shown) to desired locations of the corresponding guide posts 18 and 20. The locations of the movement stoppers 76 and 78 can be shifted with the screws loosened and re-tightened.

In action, when the weight assembly 22 is lifted up close to the uppermost point, the coil springs 72 and 74 come into direct contact with the movement stoppers 76 and 78. As their upward movement is inhibited by the stoppers 76 and 78, the coil springs 72 and 74 are compressed. In this embodiment, each of the coil springs 72 and 74 has a couple of plate-like spring receivers 80 and 82 provided at both ends thereof for giving a degree of stability during the compression of the coil spring. More particularly, the coil springs 72 and 74 are supported at one end via the spring receivers 80 by the support projections 64 and 66 respectively and arranged at the other end to come into contact via the spring receivers 82 with the movement stoppers 76 and 78 respectively.

The training action with the training machine 2 will now be described. The training machine 2 is operated for developing the arm muscles of an exerciser 16. Before starting the training action, the weight assembly 22 is set to a desired weight to be used. The setting is to select a desired number of the weights 28 to be joined with the weight connecting rod 64. When the weight of 20 kg is desired, the rod 60 of the joining member 30 is inserted from the recess 56 of the third weight 28 from the uppermost at the stack into the corresponding one of the connecting holes 58 of the weight connecting rod 26. As the third weight 28 at the stack is joined to the weight connecting rod 26, the first to third weights 28 together with the weight connecting rod 26 serve as the weight assembly 22 to be lifted.

Then, the training action starts with the exerciser 16 having the movable member 32 biased slightly towards the stool 10 (by pulling the connecting wire 44 and lifting up the weight assembly 22 to a minimum distance), as shown in FIG. 1. The grips 36 of the movable member 32 are held by the exerciser 16 who sits on the stool 10 to be ready for carrying out a program of the training action with its two arms extending horizontally. At the time, the movable member 32 remains at the original position while the weight assembly 22 is being lifted up a minimum distance from the lowermost point with the connecting wire 44 tensed.

This is followed by the two arms folding inwardly to drive the movable member 32 in the direction denoted by the arrow 38 in FIG. 2. As the movable member 32 is driven in the direction to pull the connecting wire 44, the weight assembly 22 is lifted up as resisting against its gravity. This allows the weight assembly 22 to act as a load for controlling the movement of the movable member 32 in the direction denoted by the arrow 38, thus providing a counter stress against the contraction of the muscles.

When the movable member 32 is driven to come close to the target position for the program of the training action shown in FIG. 2, it pulls the connecting wire 44 and thus lifts up the weight assembly 22 towards the uppermost point or, for example, to a location 10 cm downward from the uppermost point. Simultaneously, the coil springs 72 and 74 of the counter-force exerting means 70 come into contact with the corresponding movement stoppers 76 and 78 and then compressed as the weight assembly 22 is lifted up further to generate a counter resisting force. It may be determined that the coil springs 72 and 74 come into contact when the weight assembly 22 is lifted up to a location 5 to 15 cm downwardly from the uppermost point. When the two arms are inwardly folded to contract the muscles at the maximum, the movable member 32 arrives at the target position as shown in FIG. 2. This causes the weight assembly 22 to be lifted up to the uppermost point by the connecting wire 44 and thus receive a counter force, for example, substantially 1 kg, from the coil springs 72 and 74. The counter force created by the coil springs 72 and 74 may favorably be set to a range from 0.1 kg to 10 kg.

Then, the two arms are extended backward in the direction denoted by the arrow 40 and their muscles are relieved until the movable member 32 returns back to the original position. When the movement of the movable member 32 is switched from the target position to the original position or at the timing of shift from the upward movement to the downward movement of the weight assembly 22 (as the muscles are shifted from the contraction to the extension), the yielding force of the coil springs 72 and 74 acts as a counter force on the weight assembly 22 and inhibits its pop up action. Simultaneously, the yielding or counter force of the coil springs 72 and 74 is transmitted via the connecting wire 44 to the movable member 32 which is thus pulled in the returning direction.

For example, as the weight assembly 22 is lifted up at a higher speed, the energy of its upward movement may increase thus causing the weight assembly 22 to pop up at the uppermost point. The popping up of the weight assembly 22 can be inhibited by the action of the counter-force exerting means 70. More specifically, the weight assembly 22 is speeded up in the upward movement and its moving energy is increased. The higher the energy of the movement of the weight assembly 22, the greater the yielding force of the coil springs 72 and 74 of the counter-force exerting means 70 will increase. As the yielding force of the coil springs 72 and 74 is increased, its energy becomes a greater downward force exerted on the weight assembly 22. When the weight assembly 22 is lifted up by higher energy, the yielding force of the coil springs 72 and 74 will increase and turn to a greater counter downward force to lower the weight assembly 22. As a result, the weight assembly 22 can be inhibited from popping up at the uppermost point.

The energy of the upward movement of the weight assembly 22 is shifted to the yielding force of the coil springs 72 and 74 for triggering the counter downward movement. This causes the exerciser 16 to receive a load of the yielding (or counter) force at the timing of shift from the upward movement to the downward movement of the weight assembly 22. Accordingly, the tension of the muscles will hardly be interrupted by any abrupt relaxation.

As described, the exerciser 16 repeats the training action for driving the movable member 32 between the original position and the target position and during the training action, can remain tensed at its muscles as loaded by the weight of the weight assembly 22, hence ensuring the effective stimulation and development of its muscles through driving the movable member 32 repeatedly.

Although the movement stoppers 76 and 78 are mounted to the guide posts 18 and 20 respectively in this embodiment, they may appropriately be secured to the support frame (not shown). Also, the movement stoppers 76 and 78 may be omitted while their function is taken over by the joining member 24 coupled between the two guide posts 18 and 20.

Although the coil springs 72 and 74 are mounted to the upper most end of the weight assembly 22 for vertical movement together with the weight assembly 22 in this embodiment, they may be suspended from the joining member 24 as movably sheathed on the guide posts 18 and 20 respectively. As the weight assembly 22 is lifted up to the uppermost point, its upper surface comes into direct contact with and urges the coil springs 72 and 74 upward. In this case, the movement stoppers 76 and 78 are eliminated.

Second Embodiment

Figure 6:
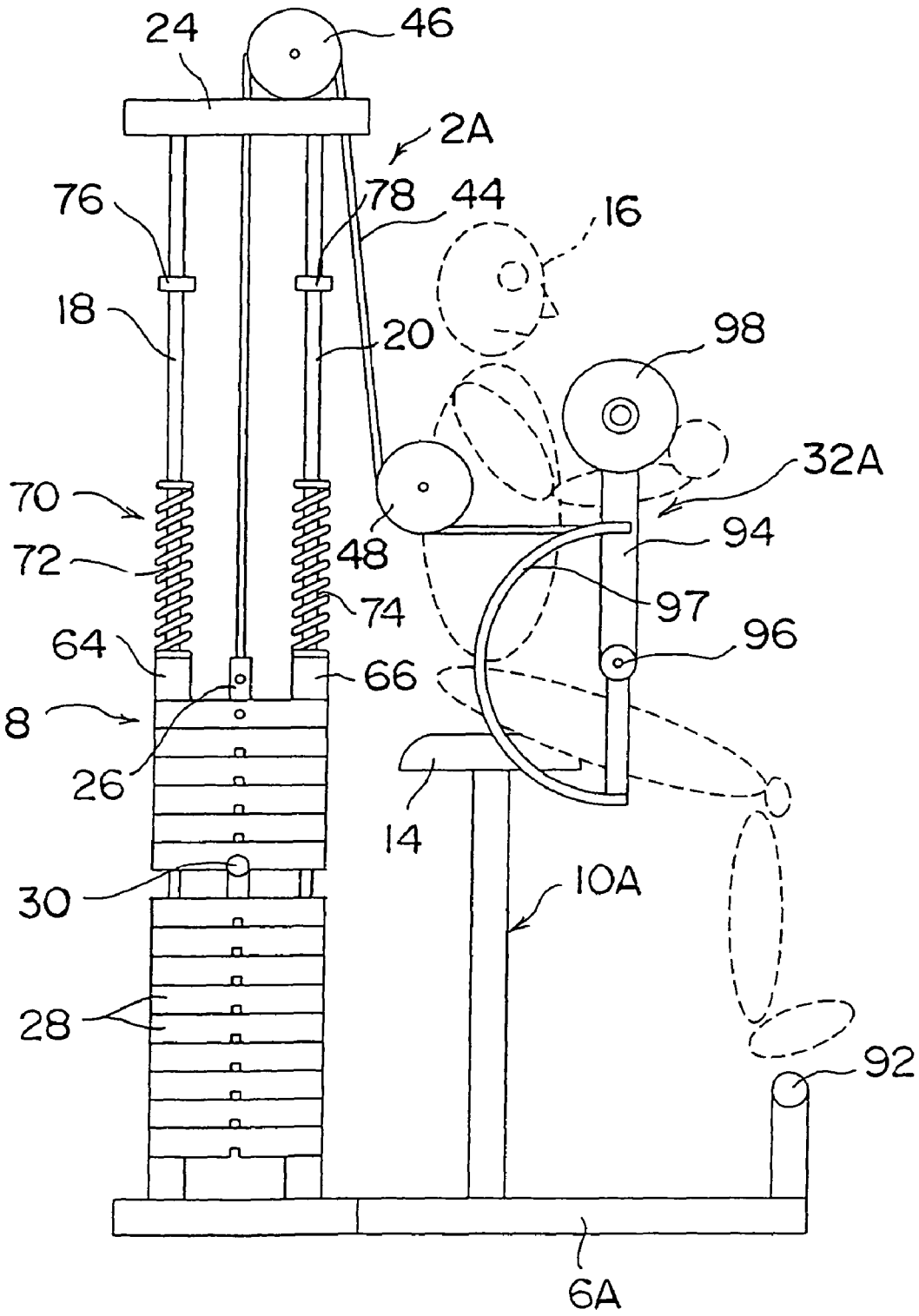
FIG. 6 is a side view schematically showing a training machine of a second embodiment of the present invention.
Figure 7:
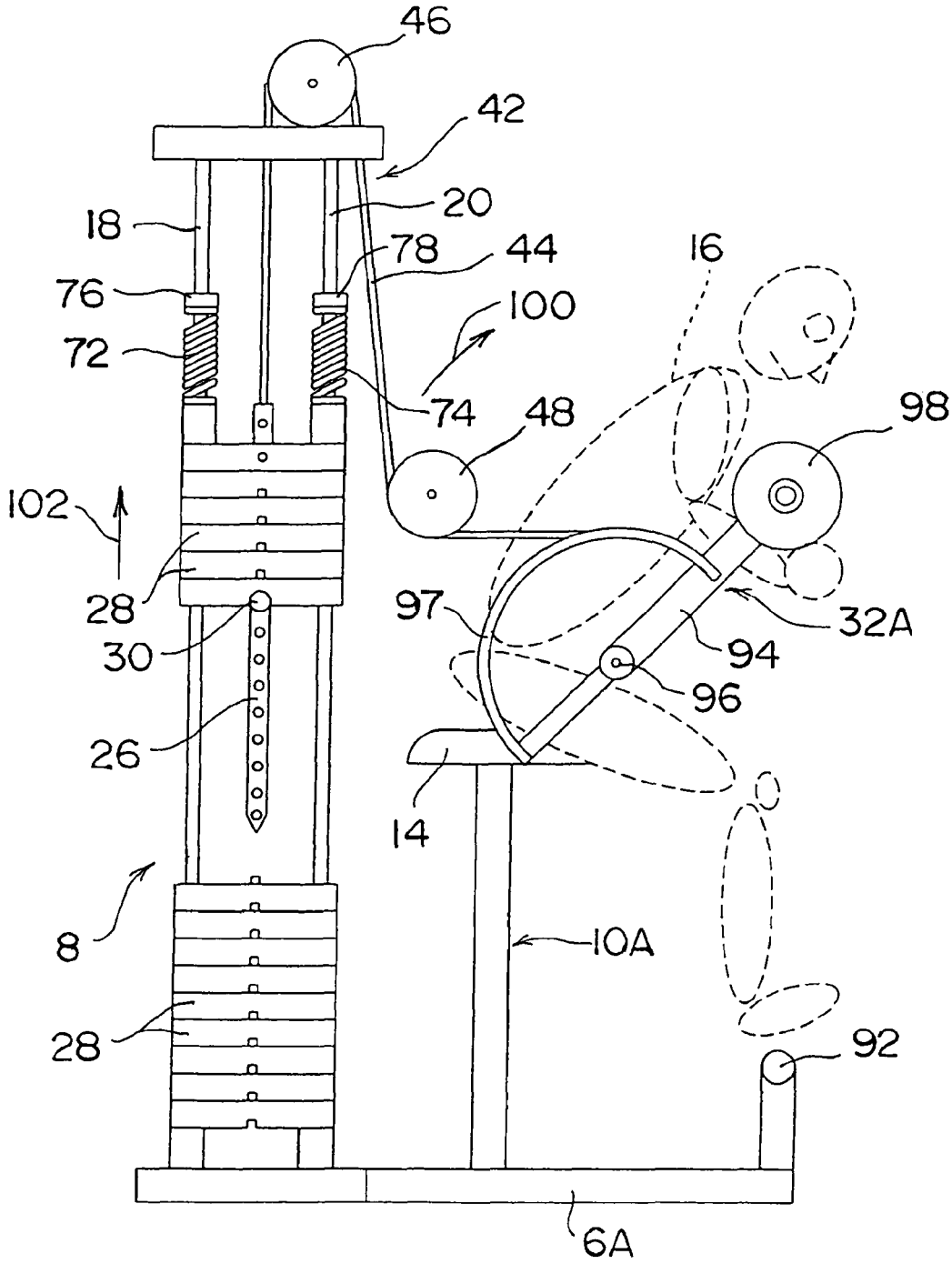
FIG. 7 is a side view of the training machine shown in FIG. 6 where the weights are lifted up to their uppermost point.

A training machine according to the second embodiment of the present invention will be described referring to FIGS. 6 and 7. FIG. 6 is a side view schematically showing the training machine of the second embodiment. FIG. 7 is a side view of the training machine shown in FIG. 6 with its weight assembly lifted up to the upper most point. Like components are denoted by like numerals as those of the first embodiment and will be explained in no more detail.

As shown in FIGS. 6 and 7, the training machine 2A is designed for development of the abdominal muscles of an exerciser 16. The training machine 2A has a stool 10A mounted on substantially a lengthwise center of a base 6A thereof. A load exerting means 8 which is identical to that of the first embodiment is provided at one side of the base 6A (on the left in FIGS. 6 and 7) while a foot rest 92 is provided at the other side (on the right in FIGS. 6 and 7).

The movable member 32 is modified to a movable member 32A which incorporates a pivotable member 94. The pivotable member 94 is pivotably joined by a pivot 96 at one end to a support frame (not shown) provided on the base 6A. The pivotable member 94 is joined at the other end with a cylindrical holder 98 which can be held from below by the two arms of the exerciser 16 while a semi-circular take-up 97 is mounted between the two ends of the pivotable arm 94. The pivotable member 94 is connected by a connecting wire 44 to the weight assembly 22 in the load exerting means 8. More particularly, while its other end is joined to the weight connecting rod 26 of the weight assembly 22, the connecting wire 44 is extended via two transfer pulleys 46 and 48, wound on the take-up 97, and joined to the pivotable member 94. The other arrangement of the second embodiment is substantially identical to those of the first embodiment. The weight assembly 22 is accompanied with a counter-force exerting means 70 which is also equal to that of the first embodiment.

Before starting the training action with the training machine 2A, the exerciser 16 sits on the seat 14 of the stool 10A facing the other side on the base 6 while resting its foot on the foot rest 92 and holding the holder 98 of the pivotable member 94 with its arms. Then, the exerciser 16 leans forward and returns back to its original position. This action is repeated for a program of the training action. When the exerciser 16 sits upright, the pivotable member 94 stays at its original position as shown in FIG. 6. Simultaneously, the weight assembly 22 at the other end of the connecting wire 44 stays at its lowermost point (shown in FIG. 6). When the body of the exerciser 16 is tilted forward with its abdominal muscles contracted, the pivotable member 94 is turned in one direction denoted by the arrow 100 to a target position as shown in FIG. 7 whereby the weight assembly 22 is lifted up to its uppermost point (shown in FIG. 7) as denoted by the arrow 102.

As a result, the training machine 2A also has the counter-force exerting means 70 composed of the coil springs 72 and 74 and the movement stoppers 76 and 78 and its action can provide the same effect as of the first embodiment. More specifically, at the timing of shift from the upward movement to the downward movement of the weight assembly 22 or when the abdominal muscles are shifted from the contraction to the relaxation, the coil springs 72 and 74 compressed (as lifted up together with the weight assembly 22 until their upper ends come into direct contact with the movement stoppers 76 and 78) create a counter force against the weight assembly 22. The counter force or yielding force of the coil springs 72 and 74 can inhibit the weight assembly 20 from popping up further from the uppermost point as being transmitted as the returning stress via the connecting wire 44 to the pivotable member 94. This allows the exerciser 16 to receive a load of the returning stress at the timing of shift from the upward movement to the downward movement of the weight assembly 22. Also, the higher the energy of the upward movement of the weight assembly 22, the greater the counter or yielding force of the coil springs 72 and 74 will increase. Accordingly, as the counter force for controlling the upward movement of the weight assembly 22 is increased, its energy can be shifted to a downward stress thus ensuring the inhibition of the popping up of the weight assembly 22.

Third Embodiment

Figure 8:
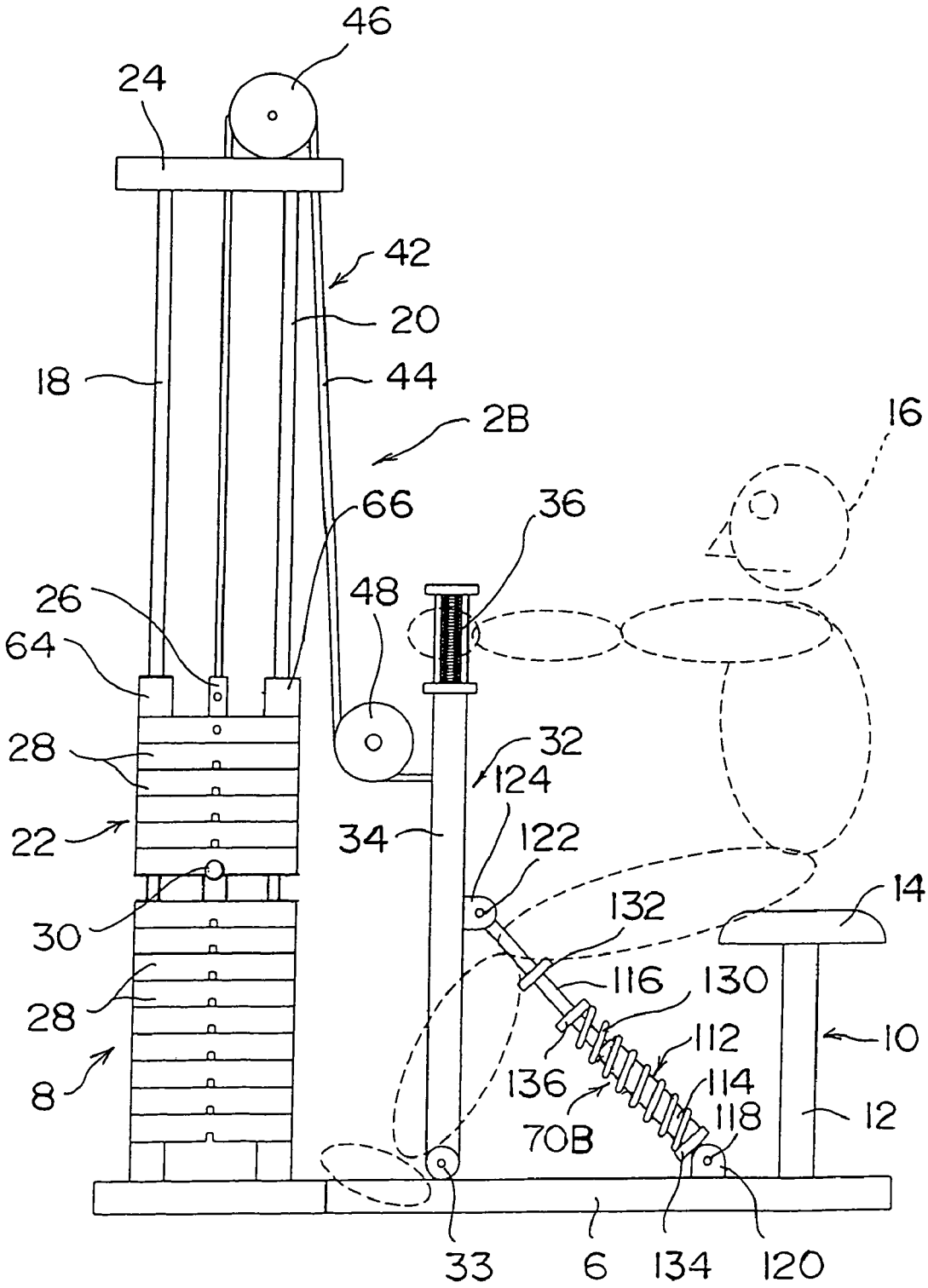
FIG. 8 is a side view schematically showing a training machine of a third embodiment of the present invention.
Figure 9:
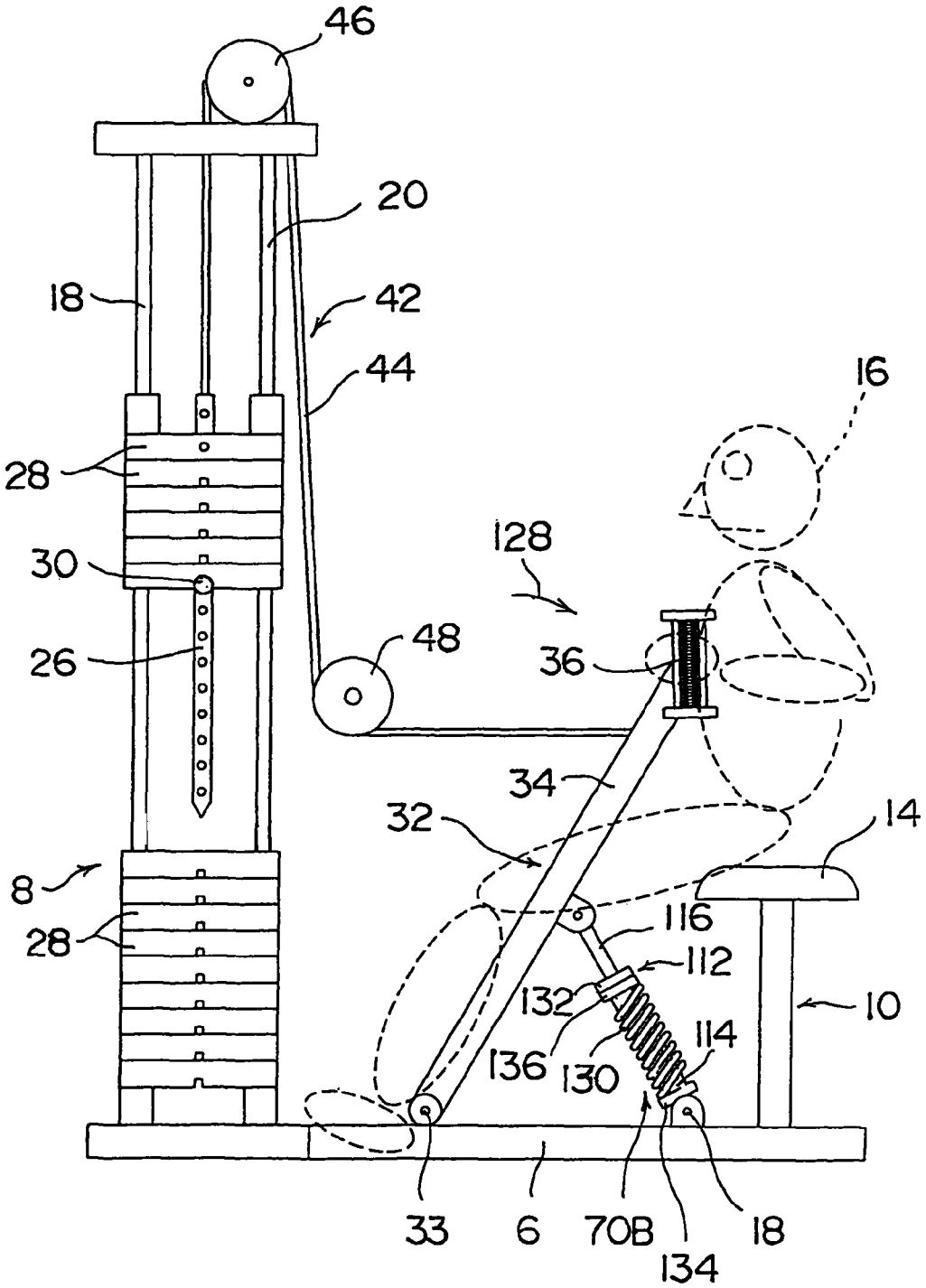
FIG. 9 is a side view of the training machine shown in FIG. 8 where the weights are lifted up to their uppermost point.

A training machine according to the third embodiment of the present invention will be described referring to FIGS. 8 and 9. FIG. 8 is a side view schematically showing the training machine of the third embodiment. FIG. 9 is a side view of the training machine shown in FIG. 8 with its weight assembly lifted up to the uppermost point. The third embodiment like the first embodiment is designed for development of the muscles of the arms of an exerciser, where the counter-force exerting means and its relevant arrangement are modified.

As shown in FIGS. 8 and 9, the training machine 2B is arranged in which the movable member 32 has a pivotable bar 34 pivotably mounted at the lowermost end by a pivot 33 to abase 6. Also, an expandable member 112 is provided between the pivotable bar 34 and the base 6. The expandable member 112 comprises, for example, a main body 114 as a cylinder housing and an expandable rod 116 as a cylinder rod. The expandable rod 116 is inserted into the main body 114 for advancing and retracting movements. More particularly, the main body 114 is pivotably coupled by a joining pin 118 to a bracket 120 anchored to the base 6 while the expandable rod 116 is pivotably coupled by a joining pin 122 to a bracket 124 anchored to the pivotable member 34. In action, when the movable member 32 is turned from its original position to a target position shown in FIG. 9 in a direction denoted by the arrow 128 as shown in FIG. 8, the expandable rod 116 moves into the main body 114 for contraction. In reverse, when the movable member 32 is returned back from the target position to the original position, the expandable rod 116 moves out from the main body 114 for advancement.

A counter-force exerting means 70B accompanied with the movable member 32 in this embodiment comprises a coil spring 130 and an actuator member 132 which acts on the coil spring 130. The coil spring 130 is mounted as sheathed on the main body 114 so that it extends at one end from the main body 114 towards the expandable rod 116. Both ends of the coil spring 130 are supported by two spring stoppers 134 and 136 respectively for stabilization of the compression. The actuator member 132 is arranged of an annular shape and joined to the expandable rod 116. More specifically, the actuator member 132 like the movement stoppers 76 and 78 of the counter-force exerting means 70 in the first embodiment is adjustably mounted by retaining screws to the expandable rod 116. The other arrangement of the third embodiment is substantially identical to that of the first embodiment.

With the training machine 2B used by the same manner as of the training machine 2 of the first embodiment, an exerciser 16 sits on the seat 14 of a stool 1A and stretches its two arms to hold the grips 36 of the movable member 32. The two arms are inwardly folded for contracting their muscles and then stretched out for relaxing the same. This contracting and relaxing action is then repeated for conducting a program of the training action. As shown in FIG. 8, with the two arms stretching straight, the movable member 32 stays at its original position (shown in FIG. 8) while the weight assembly 22 connected with the connecting wire 44 stays at its lowermost point (shown in FIG. 8). When the two arms are folded with their muscles contracted to pull the movable member 34 in a direction denoted by the arrow 128, the pivotable bar 32 turns to the target position as shown in FIG. 9 thus lifting up the weight assembly 22 connected with the connecting wire 44 to the uppermost point (shown in FIG. 9).

As the movable member 32 is turned to the target position shown in FIG. 9 (with the weight assembly 22 lifted up to the uppermost point), the expandable rod 116 of the expandable member 112 retracts with its actuator member 132 pressing via the spring stopper 136 against the coil spring 130. Upon being pressed by the driving movement of the movable member 32, the coil spring 130 creates a counter force. When the two arms are inwardly folded with their muscles contracted at the maximum, the movable member 32 reaches at the target position and the weight assembly 22 connected with the connecting wire 44 is lifted up to the uppermost point, as shown in FIG. 9, thus permitting the counter force of the coil spring 130 to act on the movement of the movable member 32.

Before the two arms are stretched gradually with their muscles relaxed for turning back the movable member 32 to its original position, the muscles of the arms are shifted from the contraction to the relaxation at the timing of shift from the upward movement to the downward movement of the weight assembly 22 (when the movable member 32 is about to switch from the direction denoted by the arrow 128). This causes the yielding or counter force of the coil spring 130 to be exerted as a returning force on the movable member 32. As a result, the exerciser 16 receives a load of the returning force at the timing of shift from the upward movement to the downward movement of the weight assembly 22. The embodiment with the counter-force exerting means 70B can also provide the same effect as of the first embodiment without the muscles being abruptly relaxed from the contraction under tension.

Although the coil spring 130 is mounted as sheathed on the main body 114 for compression with the actuator member 132 on the expandable rod 116 in the third embodiment, it may be suspended directly from the pivotable bar 34 as sheathed on the expandable rod 116. This allows the coil spring 130 to come into direct contact with the distal end of the main body 114 when the movable member 32 is turned close to the target position. This can also permit no use of the actuator member 132.

Fourth Embodiment

Figure 10:
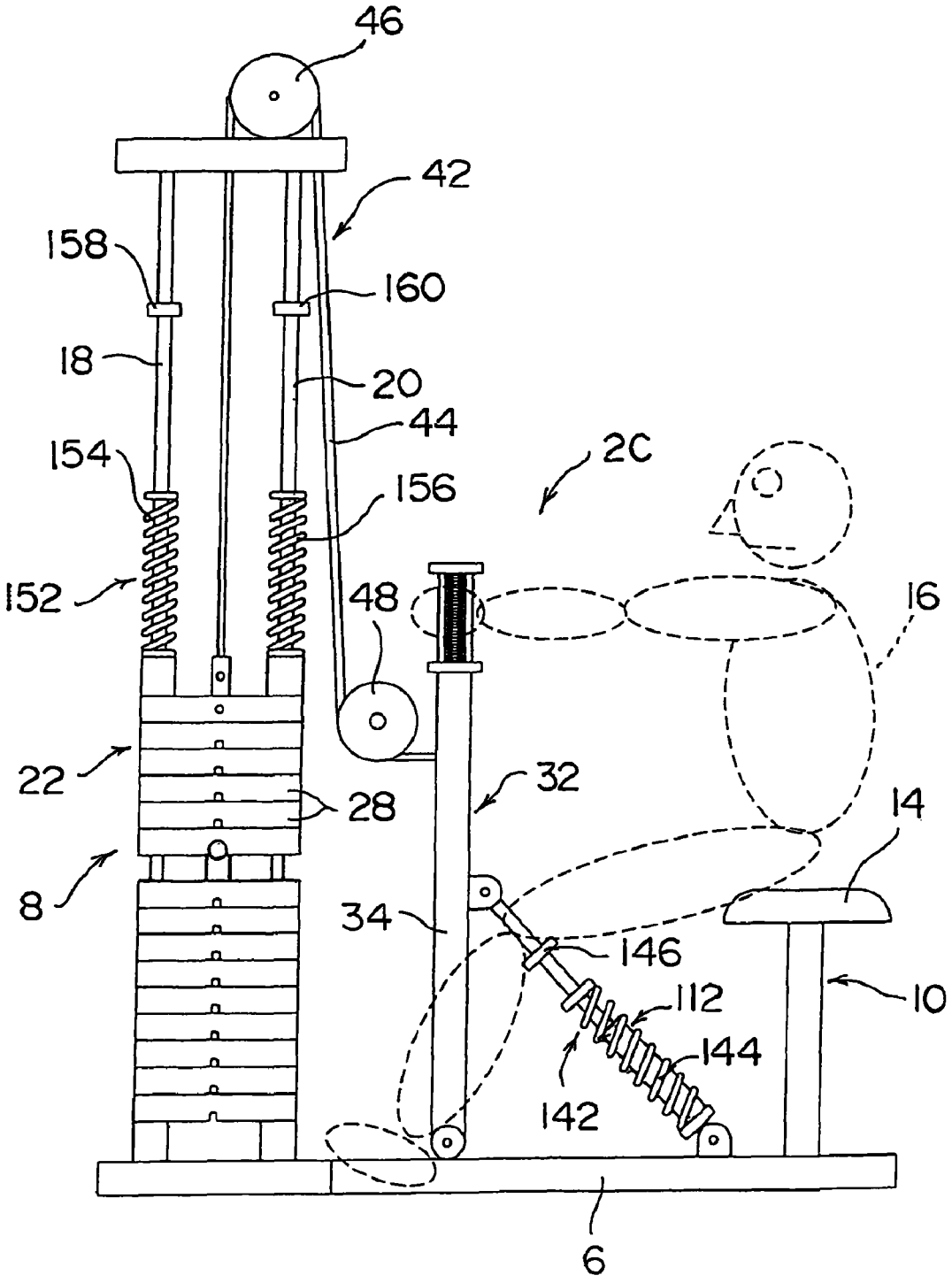
FIG. 10 is a side view schematically showing a training machine of a fourth embodiment of the present invention.
Figure 11:
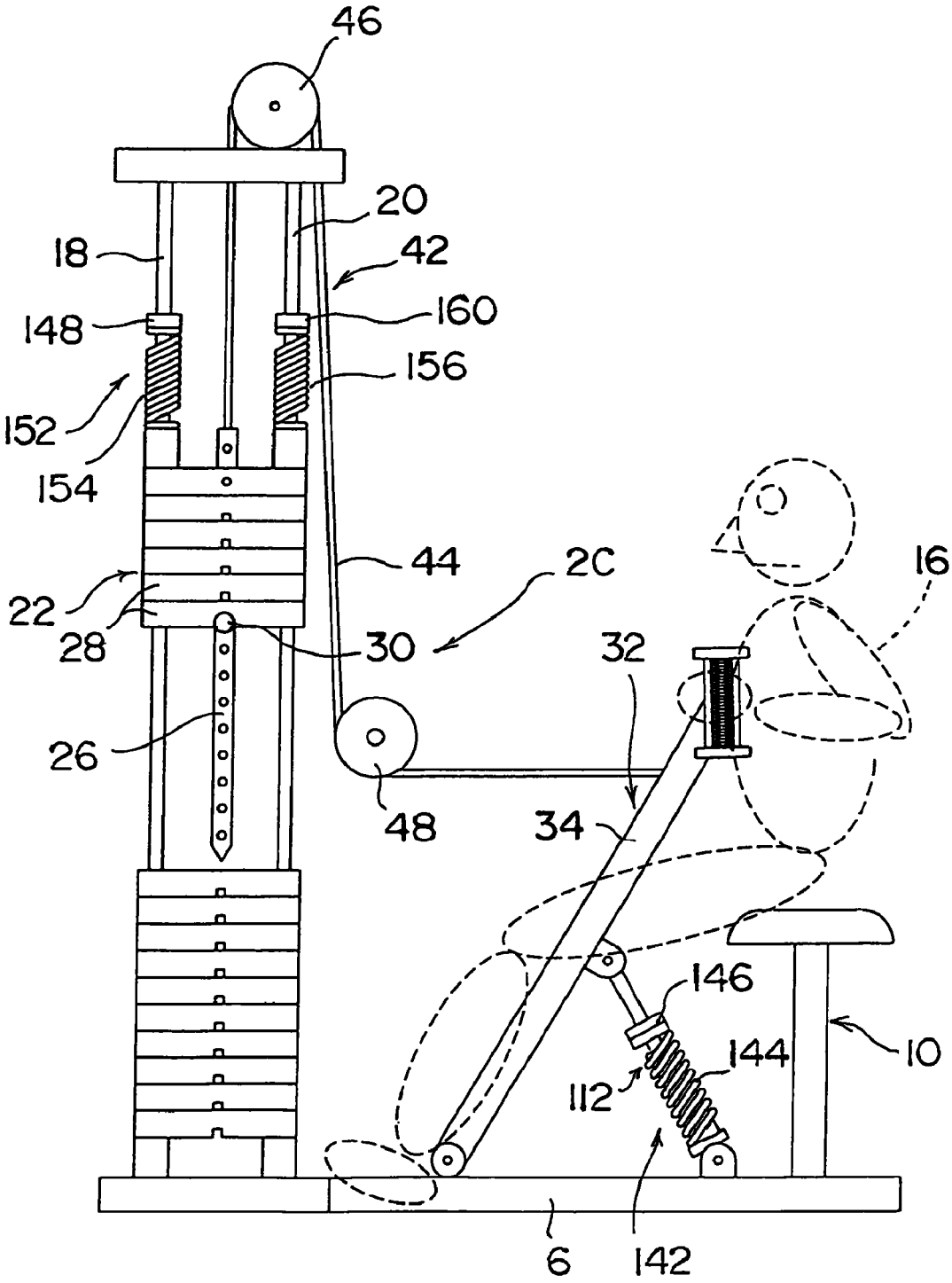
FIG. 11 is a side view of the training machine shown in FIG. 10 where the weights are lifted up to their uppermost point.

A training machine according to the fourth embodiment of the present invention will be described referring to FIGS. 10 and 11. FIG. 10 is a side view schematically showing the training machine of the fourth embodiment. FIG. 11 is a side view of the training machine shown in FIG. 10 with its weight assembly lifted up to the uppermost point. The fourth embodiment like the first embodiment is designed for development of the muscles of two arms, where the counter-force exerting means and its relevant arrangement are modified.

As shown in FIGS. 10 and 11, the training machine 2C of this embodiment is arranged in which the movable member 32 has a pivotable bar 34 pivotably mounted at the lowermost end by a pivot 33 to a base 6. Also, an expandable member 112 is provided between the pivotable bar 34 and the base 6. The movable member 32 is accompanied with a first counter-force exerting means 142. The first counter-force exerting means 142 comprises a coil spring 144 mounted as sheathed on the expandable member 112 and an actuator member 146 arranged for acting on the coil spring 144. The other arrangement and action of the first counter-force exerting means 142 is substantially identical to that of the counter-force exerting means 70B of the third embodiment.

Also, a load exerting means 8 is provided on the base 6. The weight assembly 22 is mounted on two guide posts 18 and 20 of the load exerting means 8 for lifting up and down. The weight assembly 22 is particularly accompanied with a second counter-exerting means 152. The second counter-exerting means 152 comprises a pair of coil springs 154 and 156 mounted to the upper side of the weight assembly 23 as sheathed on the guide posts 18 and 20 respectively and a pair of movement stoppers 158 and 160 arranged for restricting the movement of the coil springs 154 and 156 respectively. The other arrangement and action of the second counter-force exerting means 152 is substantially identical to that of the counter-force exerting means 70 of the first embodiment.

In the action of the fourth embodiment, when the weight assembly 22 is lifted up to the uppermost point (with the movable member 32 turned close to its target position), the actuator member 146 of the first counter-force exerting means 142 urges and compresses the coil spring 144. Simultaneously, the coil springs 154 and 156 of the second counter-force exerting means 152 come into direct contact with and thus are compressed by the two movement stoppers 158 and 160. Accordingly, at the timing of shift from the upward movement to the downward movement of the weight assembly 22 or from the contraction to the relaxation of the muscles, the yielding force of the coil spring 144 of the first counter-force exerting means 142 and the yielding force of the coil springs 154 and 156 of the second counter-force exerting means 152 are exerted in a combination on the weight assembly 22 and the movable member 32 (which both are joined to each other by the connecting wire 44). The force is also transmitted and urged as a returning force on the movable member 32. This allows an exerciser 16 to receive a load of the returning force at the timing of shift from the upward movement to the downward movement of the weight assembly 22. Accordingly, the muscles of the exerciser 16 can be effectively stimulated and developed while remaining under a degree of tension. In particular, the higher the energy of the upward movement of the weight assembly 22, the greater the yielding force of the coil springs 154 and 156 of the second counter-force exerting means 152 will increase. The yielding force can thus be shifted to an energy for triggering the downward movement of the weight assembly 22, hence ensuring the inhibition of the popping up of the weight assembly 22.

Fifth Embodiment

Figure 12:
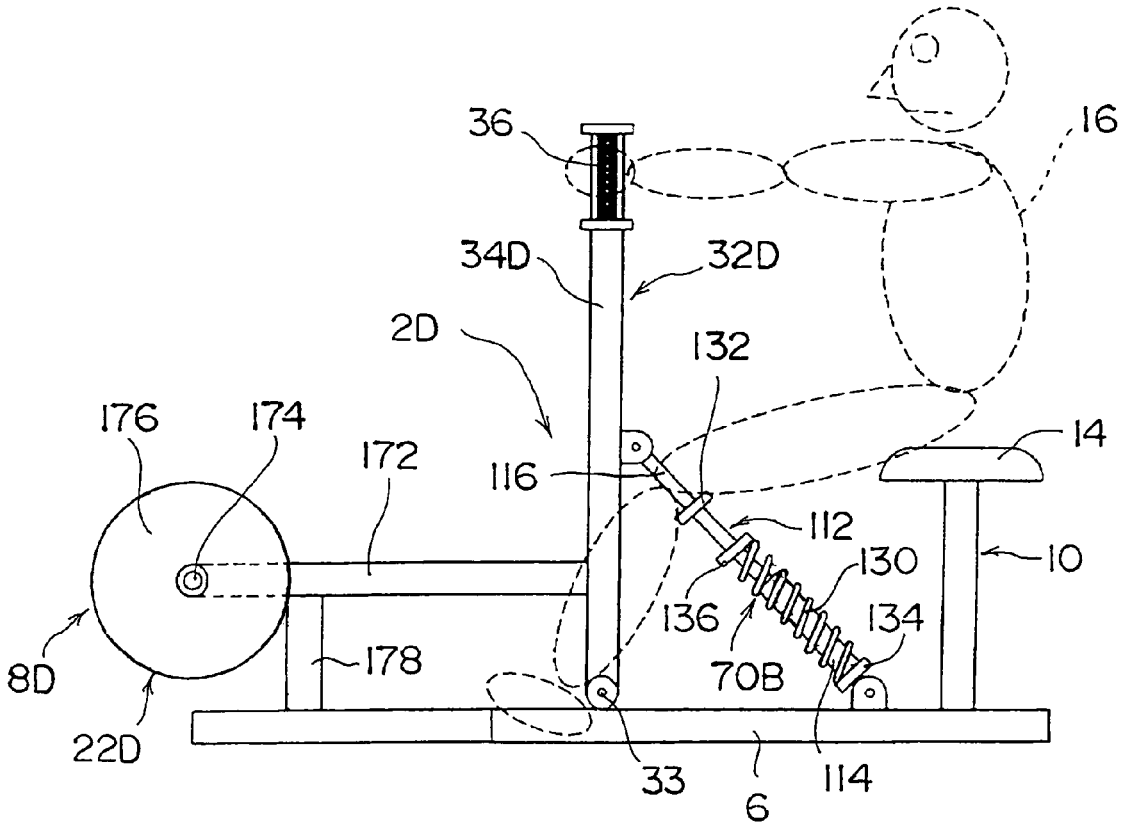
FIG. 12 is a side view schematically showing a training machine of a fifth embodiment of the present invention.
Figure 13:
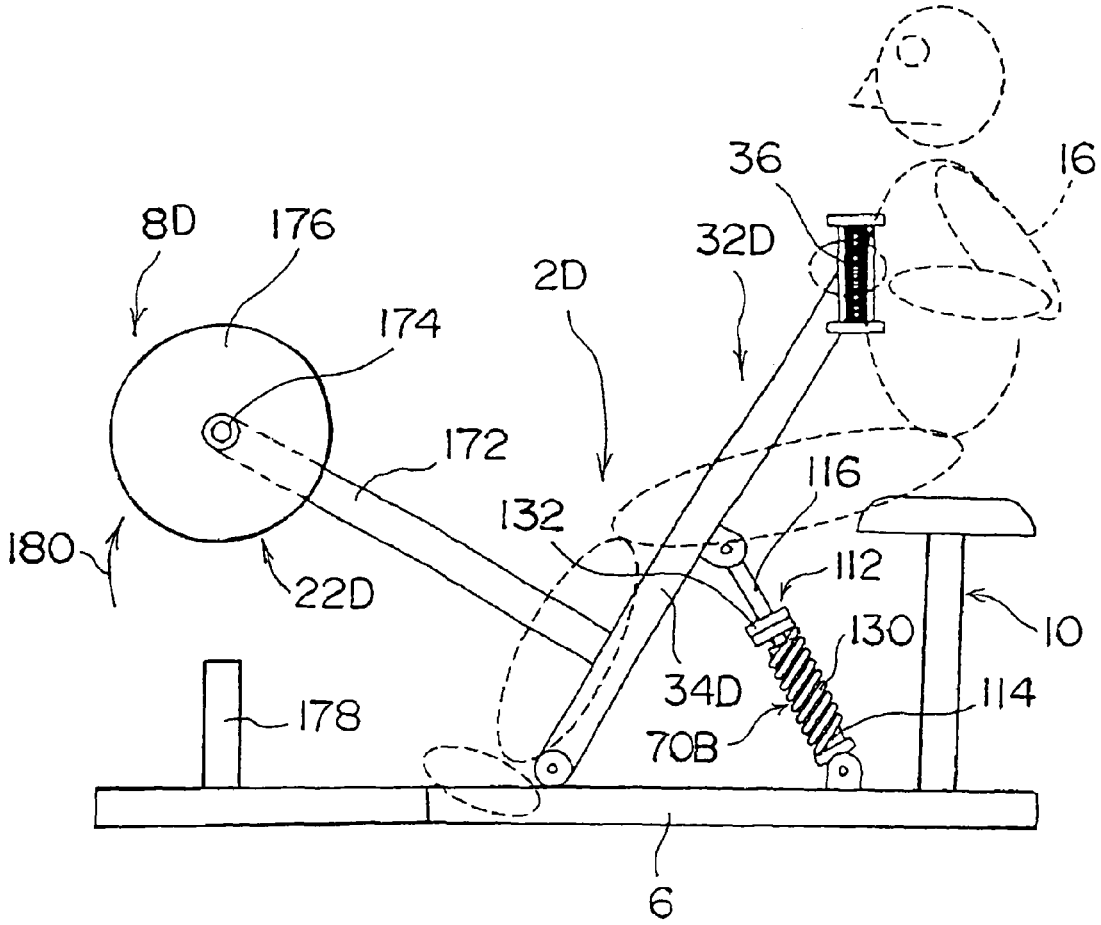
FIG. 13 is a side view of the training machine shown in FIG. 12 where the weights are lifted up to their uppermost point.

A training machine according to the fifth embodiment of the present invention will be described referring to FIGS. 12 and 13. FIG. 12 is a side view schematically showing the training machine of the fifth embodiment. FIG. 13 is a side view of the training machine shown in FIG. 12 with its weight assembly lifted up to the uppermost point. The fifth embodiment like the first embodiment is designed for development of the muscles of the arms of an exerciser, where both the load exerting means and the counter-force exerting means are modified.

As shown in FIGS. 12 and 13, a pivotable bar 34D of a movable member 32D is pivotably mounted at lowermost end by a pivot 33 to the base 6. An expandable member 112 is provided between the pivotable bar 34D and the base 6. The movable member 32D is accompanied with a counter-force exerting means 70B. The arrangements of both the expandable member 112 and the counter-force exerting means 70B are substantially identical to those of the third embodiment.

A load exerting means 8D in the fifth embodiment is arranged integral with the movable member 32D for movement. The movable member 32D has a pair of forward extending support arms 172 (one of two shown in FIGS. 12 and 13) mounted integral with the pivotable bar 34D and a support rod 174 mounted between the two support arms 172. The support rod 174 is arranged with both ends extending out from the two support arms 172 for detachably supporting weights 176 of a disk shape (so-called a barbell) which constitute a weight assembly 22D. The overall weight of the weight assembly 22D can be varied by exchanging the weights 176. Also, a pair of support stands 178 (one of two shown in FIGS. 12 and 13) are provided on the base 6 for supporting the weight assembly 22D. The other arrangement of the fifth embodiment is substantially identical to that of the first embodiment.

In the action of the fifth embodiment, when the weight assembly 22D stays at the lowermost point with the support arms 172 resting on the support stands 178, the movable member 32D stays at the original or vertical position as shown in FIG. 12. During the training action of an exerciser 16, the weight assembly 22D is repeatedly lifted up and down to move between a downward point slightly higher in a direction denoted by the arrow 180 than the lowermost point shown in FIG. 12 and the uppermost point shown in FIG. 13. When the movable member 32D is moved close to the original position (with the arms stretched straight), the weight assembly 22D comes to the downward point. When the movable member 32D is turned down to a target position shown in FIG. 13 (with the muscles of the arms contracted at the maximum), the weight assembly 22D lifts up to the uppermost point.

When the weight assembly 22D is lifted up close to the uppermost point in the training machine 2D (i.e. the movable member 32D is turned close to the target position), the actuator member 132 of the counter-force exerting means 70B urges and compresses the coil spring 130 in the same manner as of the third embodiment. At the timing of shift from the upward movement to the downward movement of the weight assembly 22D or from the contraction to the relaxation of the muscles of the arms, the yielding force of the coil spring 130 of the counter-force exerting means 70B acts as a returning force on the movable member 32D. This allows the exerciser 16 to receive a load of the returning force at the timing of shift from the upward movement to the downward movement of the weight assembly 22D. Accordingly, using the training machine 2D of this embodiment, the muscles can be effectively stimulated and developed while remaining under a degree of tension. Also, the higher the energy of the upward movement of the weight assembly 22D (in the clockwise direction in FIGS. 12 and 13), the greater the yielding force or counter-force of the coil spring 130 will increase. The counter-force can thus be shifted to an energy for triggering the downward movement (in the counter-clockwise direction) of the weight assembly 22D, hence ensuring the inhibition of the popping up of the weight assembly 22D.

Sixth Embodiment

Figure 14:
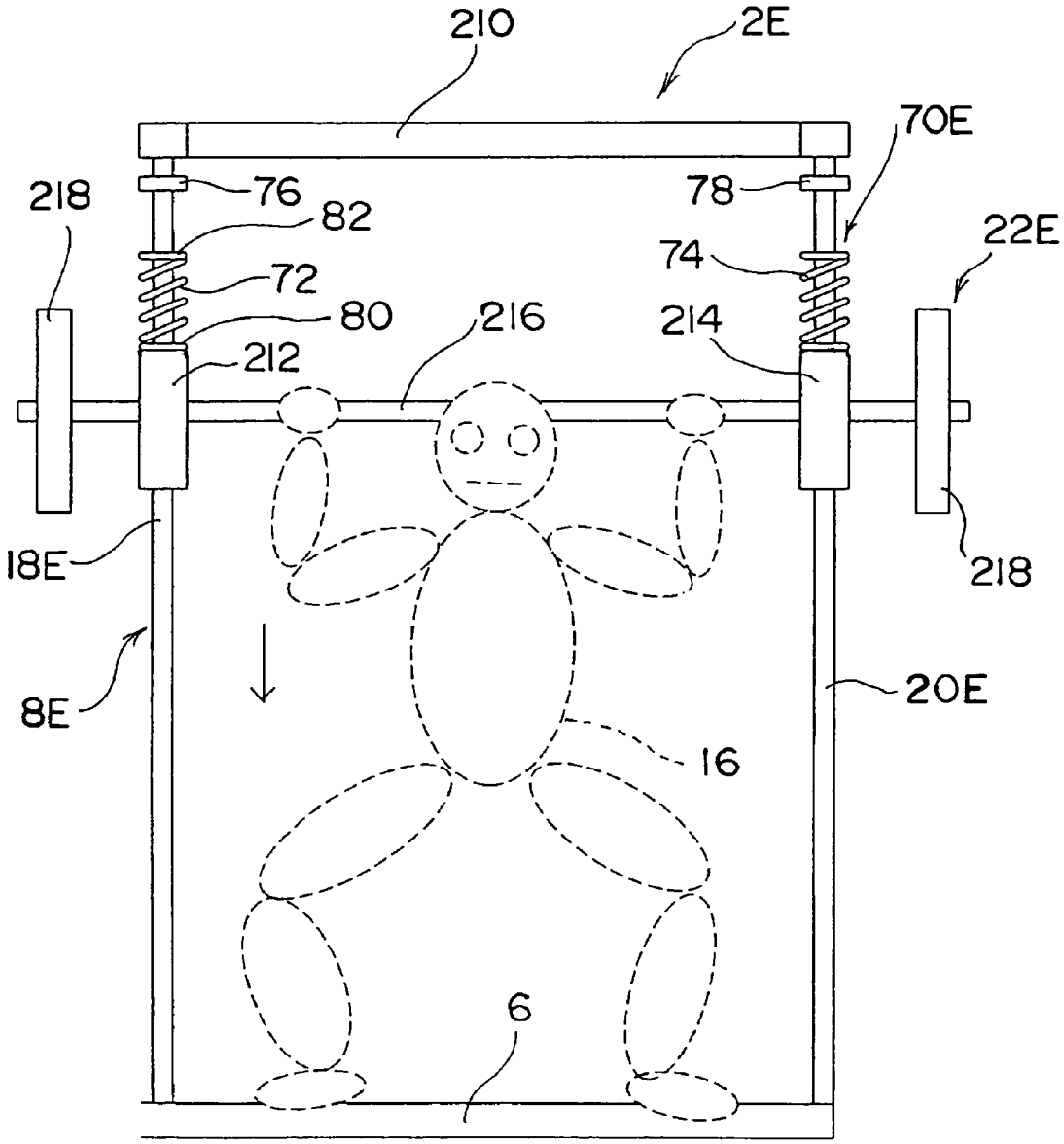
FIG. 14 is a front view schematically showing a training machine of a sixth embodiment of the present invention.
Figure 15:
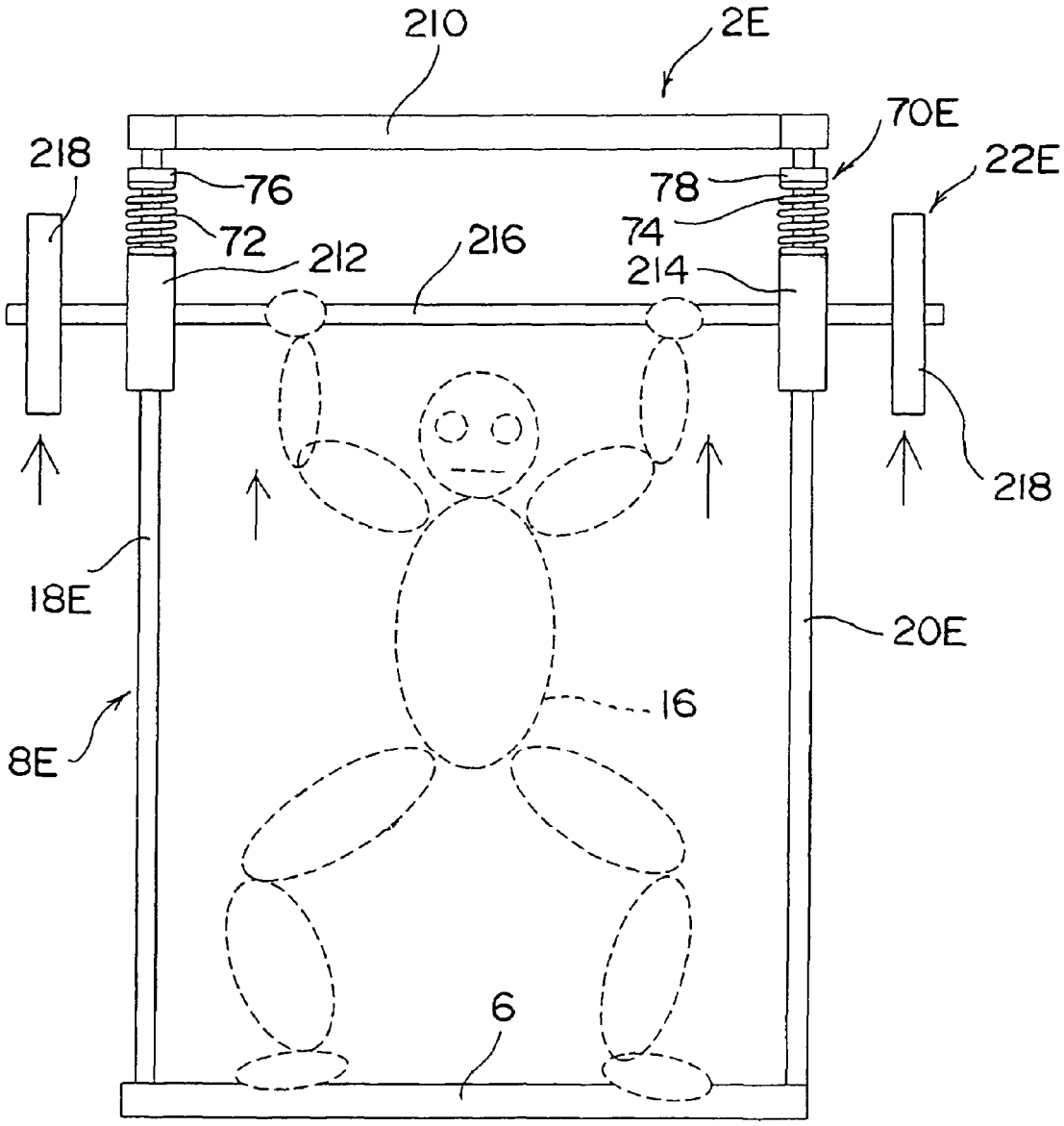
FIG. 15 is a front view of the training machine shown in FIG. 14 where the weights are lifted up to their uppermost point.

A training machine according to the sixth embodiment of the present invention will be described referring to FIGS. 14 and 15. FIG. 14 is a front view of the training machine of the sixth embodiment. FIG. 15 is a front view of the training machine shown in FIG. 14 with its weight assembly lifted up to the uppermost point.

As shown in FIG. 14, a load exerting means 8E is mounted on the base 6 of the training machine 2E. The load exerting means 8E has a pair of guide posts 18E and 20E mounted on both sides of the base 6. The two guide posts 18E and 20E extend substantially in the vertical from the base 6 and are joined at the uppermost end with a joining member 210. A pair of slides 212 and 214 are mounted on the two guide posts 18E and 20E respectively for sliding movement along the axial direction (or the vertical direction). A support rod 216 is mounted between the two slides 212 and 214 and the three members constitute a movable member to be driven for the training action.

The support rod 216 is extended outwardly at one end (on the left in FIG. 14) from the slide 212 and at the other end (on the right in FIG. 14) from the slide 214. Both ends of the support rod 216 are thus arranged for detachably supporting weights 218 of a disk shape (so-called barbells) thus constituting a weight assembly 22E. While the weight assembly 22E is arranged for directly mounting to the movable member, its overall weight can be varied by exchanging the weights 218.

In the training machine 2E, the exerciser 16 stands between the two guide posts 18E and 20E, holds the support rod 216 with its two hands, and repeats the lifting up and down of the support rod 216 with the two arms stretching and retracting as resisting against the weight of the weight assembly 22E.

The two slides 212 and 214 which serve as a part of the movable member in this embodiment are accompanied with a counter-force exerting means 70E. The counter-force exerting means 70E comprises a pair of coil springs 72 and 74 mounted to the uppermost ends of the slides 212 and 214 respectively as sheathed on the guide posts 18E and 20E and a pair of movement stoppers 76 and 78 provided for restricting the movement of the two coil springs 72 and 74 respectively. The movement stoppers 76 and 78 like those of the first embodiment are mounted to the guide posts 18E and 20E respectively so that their position can adjustably be determined along the guide posts 18E and 20E. The other arrangement of the sixth embodiment is substantially identical to that of the first embodiment.

Since the training machine 2E has the counter-force exerting means 70E composed of the coil springs 72 and 74 and the movement stoppers 76 and 78, it can provided the same effect as of the first embodiment. More particularly, when the support rod 216 is pressed up by the exerciser 16, it lifts up the slides 212 and 214 along the corresponding guideposts 18E and 20E so that the weight assembly 22 together with the support rod 216 are moved up along the guide posts 18E and 20E.

As the support rod 216 (with the weight assembly 22E) is pressed up close to the target position, the coil springs 72 and 74 come at the uppermost ends into direct contact with the corresponding movement stoppers 76 and 78. As the support rod 216 is lifted up further, it compresses the coil springs 72 and 74. At the timing of shift from the upward movement to the downward movement of the weight assembly 22E or from the contraction to the relaxation of the muscles of the two arms pressing up the support rod 216, the yielding force or counter-force of the coil springs 72 and 74 acts as a returning force via the slides 212 and 214 on the support rod 216. This allows the exerciser 16 to receive a load of the returning force at the timing of shift from the upward movement to the downward movement of the weight assembly 22E. Also, the higher the energy of the upward movement of the weight assembly 22E, the greater the yielding force of the coil springs 72 and 74 will increase. Accordingly, the counter-force can thus be shifted to an energy for triggering the downward movement of the weight assembly 22E, hence ensuring the inhibition of the popping up of the weight assembly 22E.

Seventh Embodiment

Figure 16:
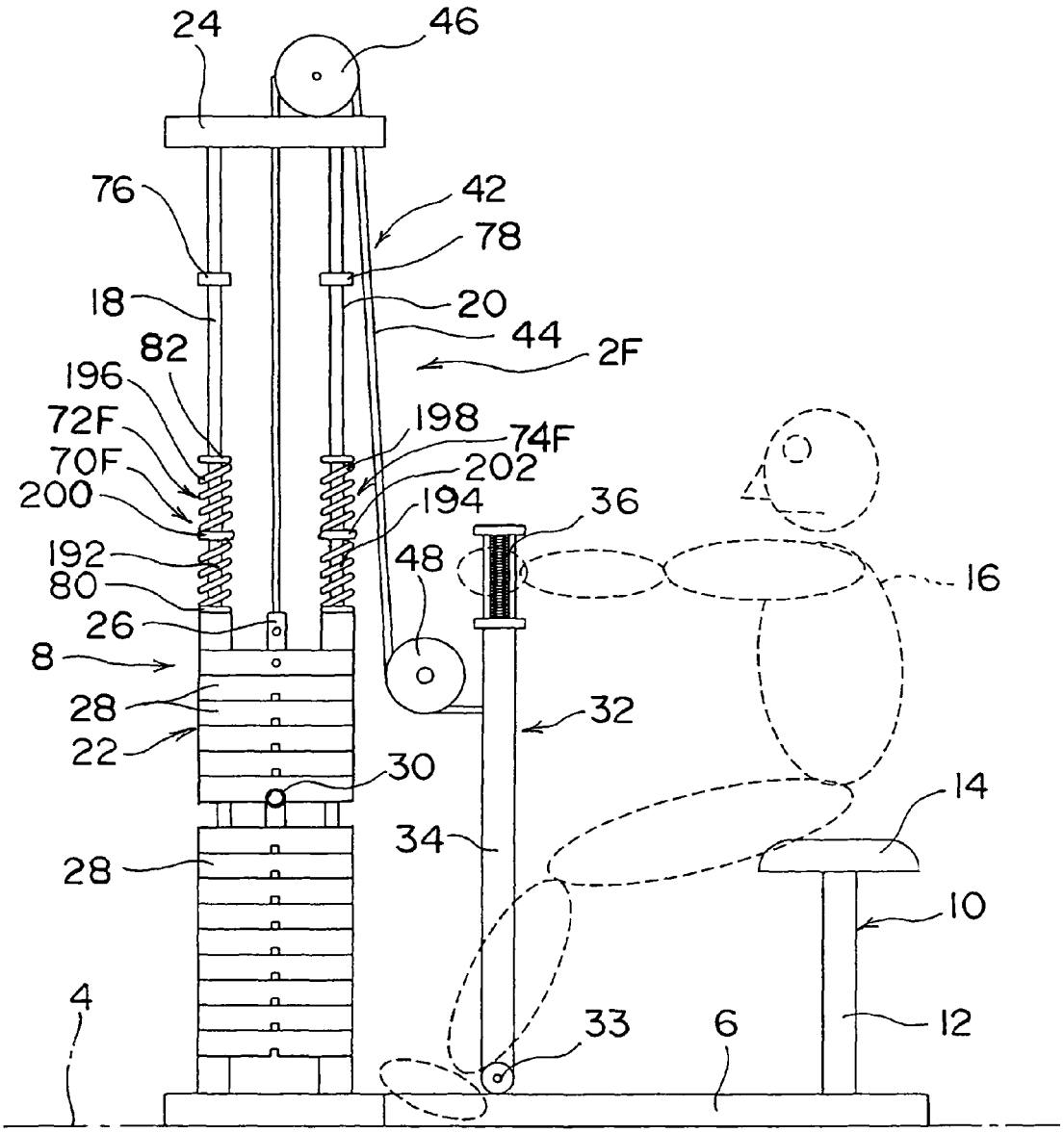
FIG. 16 is a side view schematically showing a training machine of a seventh embodiment of the present invention where the coil springs are modified.

A training machine according to the seventh embodiment of the present invention will be described referring to FIG. 16. FIG. 16 is a side view schematically showing the training machine of the seventh embodiment. The seventh embodiment like the first embodiment is designed for development of the muscles of two arms, where the counter-force exerting means is modified.

As shown in FIG. 16, the load exerting means 8 is mounted on the base 6 and has the two guide posts 18 and 20 arranged along which the weight assembly 22 is lifted up and down in the training machine 2F. The weight assembly 22 is accompanied with a counter-force exerting means 70F. The counter-force exerting means 70F comprises a pair of coil springs 72F and 74F mounted on the uppermost end of the weight assembly 22 as sheathed on the guide posts 18 and 20 respectively and a pair of movement stoppers 76 and 78 provided for restricting the movement of the coil springs 72F and 74F. Each of the coil springs 72F and 74F comprises a first coil spring segment 192 or 194 having a comparatively higher level of spring constant and a second coil spring segment 196 or 198 having a comparatively lower level of spring constant. As the first coil spring segments 192 and 194 are comparatively higher in the spring constant and thus less susceptible to the elastic deformation, they are contemplated for providing the counter force. As the second coil spring segments 196 and 198 are comparatively lower in the spring constant and thus more susceptible to the elastic deformation, they are contemplated for providing a cushioning effect at the collision.

As shown in FIG. 16, the first coil spring segments 192 and 194 are mounted to the weight assembly 22 while the second coil spring segments 196 and 198 are mounted to the two movement stoppers 76 and 78 respectively in this embodiment. Alternatively, the first coil spring segments 192 and 194 are mounted to the two movement stoppers 76 and 78 respectively while the second coil spring segments 196 and 198 are mounted to the weight assembly 22. Also, a couple of plate-like spring receivers 200 and 202 are provided between the first coil spring segment 192 and the second coil spring segment 196 and between the first coil spring segment 194 and the second coil spring segment 198 respectively for ease of the elastic deformation of the spring segments 192, 194, 196, and 198. The other arrangement of the seventh embodiment is substantially identical to that of the first embodiment.

In the seventh embodiment, when the weight assembly 22 is lifted up close to the uppermost point, the movement stoppers 76 and 78 receive (a pair of spring holders 82 and 84 of) the counter-force exerting means 72F. This causes the first and second coil spring segments 192, 194, 196, and 198 to be compressed by its effect of elastic deformation. Since the first coil spring segments 192 and 194 are comparatively higher in the spring constant and the second coil spring segments 196 and 198 are comparatively lower in the spring constant, the degree of elastic deformation (the compression) of the second coil spring segments 196 and 198 is greater than that of the first coil spring segments 192 and 194. Accordingly, while the second coil spring segments 196 and 198 provides an effect of cushioning at the collision between the counter-force exerting means 72F and the movement stoppers 76 and 78, the first coil spring segments 192 and 194 yield a counter force to be exerted on the weight assembly 22.

At the timing of shift from the upward movement to the downward movement of the weight assembly 22 or from the contraction to the relaxation of the muscles, the yielding force of the first coil spring segments 192 and 194 of the counter-force exerting means 72F is exerted on the weight assembly 22 and simultaneously transmitted as a returning force via the connecting wire 44 to the movable member 32. This causes each exerciser 16 to receive a load of the returning force at the timing of shift from the upward movement to the downward movement of the weight assembly 22. As a result, the muscles can thus be effectively stimulated and developed while remaining under a degree of tension. In addition, since the second coil spring segments 196 and 198 of the counter-force exerting means 72F provides an effect of cushioning, the collision of the counter-force exerting means 72F against the movement stoppers 76 and 78 can favorably be eased.

Accordingly, the upward and downward movements of the weight assembly 22 can be smoothed in consistency.

The application of the two spring constant different spring segments in the counter-force exerting means is not limited to the first embodiment but may successfully be used in any of the second to sixth embodiments.

Example of the Embodiment and Comparison

Some somatesthetic tests were carried out for examining the effect of the above-described training machines. One example of the training machine (a rowing machine) shown in FIGS. 1 to 5 was provided having a counter-force exerting means composed of the coil springs and the movement stoppers as accompanied with the weight assembly. The coil springs were movably mounted on the guide posts respectively while the movement stoppers are fixedly mounted to the guide posts respectively. It was arranged in that when the weight assembly was lifted up close to the uppermost point, the coil springs came into direct contact with and then were compressed by the corresponding movement stoppers.

A somatesthetic test for the training machine of the embodiment was conducted with three male adults. A resultant average of the test is shown in Tables 1 and 2. Table 1 indicates the sense of a change in the load at the timing of shift from the upward movement to the downward movement of the weight assembly. Table 2 indicates the sense of looseness in the resistance at the maximum of contraction of the muscles (when the weight assembly lifted up to the uppermost point). The training machine of the embodiment gave no sense of a change in the load at the timing of shift from the upward movement to the downward movement regardless of the overall weight of the weight assembly as well as no sense of looseness in the resistance at the maximum of the contraction of the muscles.

TABLE 1

| Sense of a change in the weight at the timing of shift | | | | | |
|---|---|---|---|---|---|
| Weight | 20 kg | 30 kg | 40 kg | 50 kg | 60 kg |
| Example | 1 | 1 | 1 | 1 | 1 |
| Comparison | 5 | 5 | 4 | 4 | 3 |

*The evaluation is in five grades where "1" represents no sense of a change and "5" represents a sense of lightness.

TABLE 2

| Sense of looseness in the resistance at the maximum of contraction of the muscles | | | | | |
|---|---|---|---|---|---|
| Weight | 20 kg | 30 kg | 40 kg | 50 kg | 60 kg |
| Example | 1 | 1 | 1 | 1 | 1 |
| Comparison | 5 | 5 | 4 | 3 | 2 |

*The evaluation is in five grades where "1" represents no sense of looseness and "5" represents a sense of higher looseness.

A comparison somatesthetic test for the training machine of the embodiment excluding the counter-force exerting means was conducted with the same three male adults as of the preceding test. A resultant average of the comparison test is also shown in Tables 1 and 2. The comparison training machine was found that the lighter the overall weight of the weight assembly, the greater the sense of a change in the load at the timing of shift from the upward movement to the downward movement was received. It was also found in the comparison test that the sense of looseness in the resistance was great at the maximum of contraction of the muscles and remained slightly when the weight was loaded.

It is proved through the somatesthetic test that the training machine equipped with the counter-force exerting means allows the muscles of each exerciser to remain under a degree of tension throughout the training action thus ensuring the effective stimulation and development of the muscles to be trained.

The training machines according to the present invention has the counter-force exerting means arranged to impart a load of the returning force to the muscles of each exerciser at the timing of shift from the upward movement to the downward movement of the weight assembly, whereby the muscles remain under a degree of tension throughout the training action without being abruptly relaxed from the contraction temporarily and can thus be effectively stimulated and developed. The counter-force exerting means may be installed in any type of training machine hence ensuring the training action of every exerciser at higher effectiveness.

What is claimed is:

1. A training machine comprising:

a base arranged for placement on the floor;

a movable member provided on the base to be moved by the training action;

a weight assembly comprising a plurality of weights; and a load exerting means for exerting a load to control the movement of the movable member, wherein the load exerting means comprises the weight assembly thereof arranged to be lifted vertically by the movement of the movable member as resisting gravity and a counter-force exerting means for exerting a return force on the movable member and preventing at least one of the plurality of weights of the weight assembly from lifting upward at a timing of shift from an upward movement to a downward movement of the weight assembly;

the counter-force exerting means comprises a first coil spring segment and a second coil spring segment, the first coil spring segment has a higher spring constant than the second coil spring segment, and the first coil spring segment exerts the counter-force and the second coil spring segment provides a cushioning effect, and the counter-force exerting means is arranged at the weight assembly and acts on the weight assembly.

2. A training machine according to claim 1, wherein the movable member has a weight mount thereof provided for installation of the weight assembly while the counter-force exerting means is arranged at the weight mount.

3. A training machine according to claim 1, wherein the load exerting means has guide posts thereof provided extending substantially in the vertical on the base and arranged on which the weight assembly is liftably mounted, the weight assembly and the movable member are connected to each other by a connecting means, and the counter-force exerting means is arranged at the weight assembly.

4. A training machine according to claim 2 or 3, wherein the weight assembly stays at the lowermost point when the movable member is at its original position and is lifted up to an upward point higher than the lowermost point when the movable member is moved to a target position, and wherein the counter-force exerting means is arranged at the movable member to exert a counter force on the movable member when the weight assembly is lifted up close to the upward point by the movement of the movable member towards the target position, whereby the movable member can be urged by a returning force.

5. A training machine comprising:

a base arranged for placement on the floor;

a movable member provided on the base to be moved by the training action;

and a load exerting means for exerting a load to control the movement of the movable member, wherein:

the load exerting means has a weight assembly thereof arranged to be lifted vertically by the movement of the movable member as resisting the gravity and a counter-force exerting means arranged at the weight assembly and/or the movable member for exerting a returning force on the movable member at the timing of shift from the upward movement to the downward movement of the weight assembly, the movable member has a weight mount thereof provided for installation of the weight assembly while the counter-force exerting means is arranged at the weight mount and/or the movable member, and the counter-force exerting means comprises an expandable member provided between the base and the movable member, a coil spring mounted to as sheathed on the expandable member, and an actuator member arranged for acting on the coil spring as moving together with movable member, and wherein when the weight assembly is lifted up close to the upward point by the movement of the movable member towards the target position, the actuator member acts on and compresses the coil spring which in turn exerts a counter or returning force on the movable member.

6. A training member according to claim 5, wherein the expandable member comprises a main body and an expandable rod arranged to be inserted into the main body, the main body mounted to the base, the expandable member mounted to the movable member, and wherein the coil spring is mounted to as sheathed on the main body and the actuator member is mounted to the expandable rod so that its location can selectively be determined.

7. A training machine according to claim 3, wherein the weight assembly connected with the connecting means stays at the lowermost point when the movable member is at its original position and is lifted up to an upward point via the connecting means when the movable member is moved to a target position, and wherein the counter-force exerting means is arranged at the weight assembly to exert a counter force on the weight assembly when the weight assembly is lifted up close to the upward point by the movement of the movable member towards the target position, whereby the movable member can be urged by a returning force.

8. The training machine according to claim 7, wherein the first and the second coil spring segments are mounted to the uppermost end of the weight assembly as sheathed on the guide posts respectively and movement stoppers arranged for restricting the upward movement of the first and the second coil spring segments which can be lifted up and down together with the weight assembly, and wherein when the weight assembly is lifted up close to the upward point, the movement stoppers come into contact with and restrict the upward movement of the first and the second coil spring segments, whereby the first and the second coil spring segments upon being compressed can exert a counter force on the weight assembly.

9. A training machine according to claim 8, wherein the movement stoppers are mounted to the guide posts respectively so that their location can selectively be determined.

10. The training machine according to claim 1, wherein the return force exerted by the counter-force exerting means is at least 3.0 kg.

11. The training machine according to claim 5, wherein the return force exerted by the counter-force exerting means is at least 0.1 kg.

* * * * *